US009902047B1

(12) United States Patent
Juranitch et al.

(10) Patent No.: US 9,902,047 B1
(45) Date of Patent: Feb. 27, 2018

(54) SHARPENING APPARATUS FOR SCISSORS

(71) Applicant: Razor Edge Systems, Inc., Ely, MN (US)

(72) Inventors: Joseph C. Juranitch, Babbitt, MN (US); John R. Juranitch, Ely, MN (US)

(73) Assignee: Razor Edge Systems, Inc., Ely, MN (US)

( * ) Notice: Subject to any disclaimer, the term of this patent is extended or adjusted under 35 U.S.C. 154(b) by 93 days.

(21) Appl. No.: 14/802,757

(22) Filed: Jul. 17, 2015

(51) Int. Cl.
*B24D 15/06* (2006.01)
*B24D 15/02* (2006.01)
*B24B 3/52* (2006.01)
*B24D 15/08* (2006.01)

(52) U.S. Cl.
CPC ..... *B24D 15/06* (2013.01); *B24B 3/52* (2013.01); *B24D 15/02* (2013.01); *B24D 15/063* (2013.01); *B24D 15/081* (2013.01)

(58) Field of Classification Search
CPC .. B24B 3/52; B24B 3/54; B24D 15/02; B24D 15/063; B24D 15/065; B24D 15/081
See application file for complete search history.

(56) References Cited

U.S. PATENT DOCUMENTS 1,897,662 A * 2/1933 Farrar ..... B24D 15/063 451/175
1,964,627 A * 6/1934 Gaw ..... B24D 15/063 407/29.15
2,061,842 A * 11/1936 Louden ..... B24D 15/063 451/163
2,304,420 A * 12/1942 Rains ..... B24D 15/063 76/82.2
3,885,352 A 5/1975 Juranitch
3,942,394 A 3/1976 Juranitch
4,216,627 A * 8/1980 Westrom ..... B24D 15/063 451/175
4,450,653 A * 5/1984 Fletcher ..... B24D 15/08 248/171

(Continued)

OTHER PUBLICATIONS

Razor Edge Systems brochure for "Scissor Saver" scissors sharpener product (2013).

*Primary Examiner* — Timothy V Eley
(74) *Attorney, Agent, or Firm* — DeWitt Ross & Stevens SC

(57) ABSTRACT

A small and portable apparatus for sharpening the blades of a pair of scissors is provided according to the invention. The scissors sharpener comprises a main body; a vertically-oriented, stationary sharpening steel having opposed surfaces that is securely attached to the main body; a pivotable sharpening steel that rotates with respect to the main body; and a U-shaped return spring positioned between the main body and the pivotable sharpening steel. A user inserts a pair of scissors so that the inside surfaces of the two blades abut the opposed surfaces of the stationary sharpening steel for stable alignment, and closes the blades against the pivotable sharpening steel to cause it to travel along the blade cutting edges to sharpen them. When the scissors blades are disengaged from the scissors sharpening apparatus, the return spring will bias the pivotable sharpening steel back to its standby position.

10 Claims, 21 Drawing Sheets

(56) References Cited

U.S. PATENT DOCUMENTS

| | | | | |
|---|---|---|---|---|
| 4,624,079 | A * | 11/1986 | Bonapace | B24D 15/081 451/555 |
| 4,852,305 | A | 8/1989 | Juranitch | |
| D686,895 | S | 7/2013 | Juranitch | |
| 8,951,098 | B2 * | 2/2015 | Jhones | B24D 15/081 451/45 |

* cited by examiner

SHARPENING APPARATUS FOR SCISSORS

FIELD OF INVENTION

This invention relates to an apparatus for sharpening the cutting edge of a scissors blade, and more specifically to such an apparatus that is hand-held and portable for simultaneously sharpening and polishing the interior and exterior surfaces of the cutting blades of the scissors without the need for a sharpening or honing wheel or a skilled scissors sharpener.

BACKGROUND OF THE INVENTION

Scissors represent a hand-operated shearing tool used for cutting various thin materials like paper, metal, foil, plastic, or rope. They also are employed by barbers, beauticians, and pet groomers to cut hair.

Scissors consist of a pair of metal blades pivoted so that their sharpening edges slide against each other when the respective handles opposite to the pivot point are closed by the user's hand. The two blades having sharpened edges that cooperate when the scissor blades are closed to produce a precise cut along a material that needs to be cut.

But, over time, these sharpened edges of the scissors blades will become dull. Moreover, tougher or abrasive materials will cause the blades to become dull more quickly. Dull blades do not cut as easily or precisely, and can create a danger to the end user by requiring greater hand force to make a cut. Moreover, dulled blades can include rolled edges, burrs, or ragged edges with regions along the cutting surface that are out of alignment with each other. Such misaligned blades can damage the material being cut.

Therefore, such dulled scissors blades must be periodically sharpened. Typically, grinding wheels or whetstones have been used to restore the cutting edges along the blades of scissors. But, this constitutes a precise operation in which the angle of the cutting edge of the blade must match the angle of the whetstone or grinding wheel surface. It is easy to damage the cutting edge of the scissors blade further if the sharpening exercise is performed poorly. Thus, most scissors users need to send out their dulled scissors to a professional sharpening service, or to replace the scissors with a new pair of scissors. This can be time-consuming and expensive.

Other scissors users have been known to employ more humble methods for sharpening dulled scissors blades. For example, taking a pair of scissors and cutting three strips of sand paper allegedly will restore some degree of sharpness to the cutting edges due to the movement of the cutting edges against the abrasive particles on the sand paper. Other "home-grown" methods for sharpening scissors blades include cutting a pin while sliding it forward along the scissors blades, cutting a couple of strips of aluminum foil that are folded multiple times to produce a thick stack, or pushing the scissors blades against the exterior surface of a glass cylinder like a drinking glass or soda bottle while closing the scissors. However, while these methods do not require expensive equipment or technical skill, they are believed to do a better job of polishing an already-sharpened scissors blade than sharpening the blade itself.

U.S. Pat. No. 3,942,394 issued to Juranitch is directed to a finishing sharpener device specially designed for sharpening a knife blade. It includes a handle having a pair of wings extending therefrom. Each of the wings constitutes a flat bar defining a sharpening edge that is arcuate in cross section and smooth. By drawing a dulled knife blade cutting edge across the sharpening edge of one of the wings at the proper angle, the knife blade cutting edge may be restored to its sharpened configuration. The handle of the finishing sharpener serves as a guide for properly drawing the knife blade along the wing's sharpening edge. But, this process still requires some skill by the person sharpening the knife blade to ensure a proper match of the knife blade cutting edge angle with the angled surface of the sharpening edge of the wing. Moreover, the arcuate cross-section surface of relatively small radial extent having a highly smooth configuration is insufficient for removing material from the cutting edge of the knife blade. This finishing sharpener may only be used after the knife blade is sharpened first on a hone or grinding wheel.

Razor Edge Systems of Ely, Minnesota has commercialized a SCISSORSAVER device useful for sharpening, steeling, or maintaining the cutting edges of scissors blades, particularly for use in the meat processing industry. It constitutes a sharpening steel that is engaged by the dulled blades of a scissors closed against the sharpening steel. It also has a vertical post for aligning the scissors blades and providing some sharpening functionality to the interior edge of the blades. The sharpening steel is positioned above the vertical post, so that when the sharpened scissors is removed from the SCISSORSAVER device, the upper sharpening steel falls by means of gravity to return to its standby position against the vertical post. But, this SCISSORSAVER device represents a relatively large, stationary-mounted apparatus that can be positioned in front of or next to a meat processing or factory assembly line worker. It is not particularly useful for barbers, beauticians, pet groomers, crafters, florists, or home users of scissors who would benefit from a small, portable sharpening device. Furthermore, this device must be carefully installed in such a position as to ensure that the upper sharpening steel will, in fact, fall back upon the lower vertical post when the scissors is removed from the device. Otherwise, the upper sharpening steel will not be available to sharpen again a pair of scissors.

Therefore, it would be very advantageous to provide a sharpening apparatus that may be used by a relatively unskilled person to simultaneously sharpen the interior and exterior surfaces of the cutting edge of both blades of a scissors by hand and with minimal effort and training. Such an apparatus should be small and portable so that the person may take it out to sharpen the cutting edge of the scissors blades when needed, as opposed to mounting the sharpening apparatus in a stationary location. Moreover, the device should enable the sharpening of the blades of the scissors due to a simple closing of the scissors blades around the sharpening steels of the apparatus. Furthermore, the sharpening apparatus should automatically return itself from its sharpening position to its standby position without regard to the orientation of the device in three-dimensional space. Such a sharpening apparatus can be used to maintain an extremely sharp scissor edge for precise cutting of a material like hair without crushing or other damage with significantly reduced physical force and strain upon the user.

SUMMARY OF THE INVENTION

An apparatus for the sharpening the blades of a pair of scissors is provided according to the invention. The scissors sharpener comprises a main body having a top surface; a stationary sharpening steel having opposed surfaces that is securely attached to the main body; a bracket secured to the main body having a pivotably mounting assembly; a pivotable sharpening steel having a mounting plate connected to the pivotable mounting assembly; and a U-shaped return spring positioned between the bracket and the mounting plate of the pivotable sharpening steel. The stationary sharpening steel extends vertically above the top surface of the main body. The pivotable sharpening steel rotates with respect to the main body. When a user inserts a pair of scissors so that the inside surfaces of the two blades abut the opposed surfaces of the stationary sharpening steel, and the blades extend beyond the vertical sharpening steel positioned above and below the pivotable sharpening steel, the blades are closed against the pivotable sharpening steel to rotate the pivotable sharpening steel in a horizontal plane with respect to the main body to travel from its standby position along the blade cutting edges, while the vertical sharpening steel provides stable alignment of the scissors with respect to the scissors sharpening apparatus and sharpens the interior of the cutting edges. When the scissors blades are disengaged from the scissors sharpening apparatus, the return spring will bias the pivotable sharpening steel back to its standby position to be ready for sharpening the next pair of scissors.

The pivotable sharpening steel extends at an upwardly inclined angle in a vertical plane from the pivotable mounting assembly attached to the main body in order to reduce choking of the scissors blades as the pivotable sharpening steel travels along their cutting edges during the sharpening operation. The bracket mounted to the main body can also pivot with respect to the main body so that the pivotable sharpening steel rotates in a vertical plane while it is also pivoting in the horizontal plane during the scissors sharpening operation. This will further reduce potential chocking of the pivotable sharpening steel along the scissors blades during the sharpening operation.

The pivotable sharpening steel preferably comprises a straight segment and two curved segments where the straight segment approaches a longitudinal axis at an angle, the first curved segment is bowed away from the longitudinal axis, and the second curved segment is bowed back towards the longitudinal axis. It has been found that this curved configuration of the pivotable sharpening steel produces a sharper cutting edge along the scissors blade. In another embodiment of the invention, the first curved segment can be bowed towards the longitudinal axis, while the second curved segment bows away from the longitudinal axis. It has been found that this cured curved configuration of the pivotable sharpening steel produces a stronger finish to the sharpened cutting edge of the blade. Two sharpening apparati having these different curved configurations for the pivotable sharpening steel may be used sequentially to sharpen the cutting edges of the scissors blades, and then strengthen their finish.

In still another embodiment of the scissors sharpening apparatus, a horizontal niche may be formed within the top surface of the main body with the stationary sharpening steel being omitted. The horizontal niche is used to provide stable alignment of the scissors blades within the main body and with respect to the pivotable sharpening steel during the sharpening operation. The scissors blade cutting edges are sharpened by the pivotable sharpening steel as described above without the need to manipulate the scissors blades along a vertical stationary sharpening steel. This enables quicker engagement by the scissors blades with the sharpening apparatus to shorten the time required to sharpen their cutting edges.

The scissors sharpening apparatus of the present invention is smaller and more portable than known prior art devices. Therefore, it may be conveniently accessed and used not only by a person using a scissors on a meat packing or factory assembly line, but also by users of scissors in less industrial settings like a barber, beautician, pet groomer, florist, or crafter. Moreover, the scissors sharpener apparatus may be used quickly and conveniently without reference to its position in three-dimensional space, because unlike prior art devices, gravity is not required to return the sharpening steel to its standby position after the pair of scissors is disengaged from the device.

DETAILED DESCRIPTION OF THE PREFERRED EMBODIMENT

Figure 1:
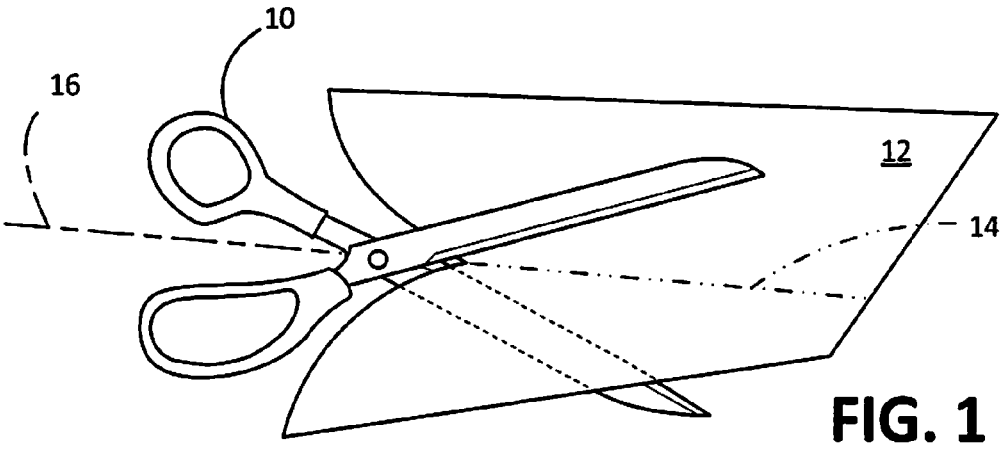
FIG. 1 is a perspective view of a pair of scissors cutting a flat material like a piece of paper.

A small and portable apparatus for the sharpening the blades of a pair of scissors is provided according to the invention. The scissors sharpener comprises a main body having a top surface; a stationary sharpening steel having opposed surfaces that is securely attached to the main body; a bracket secured to the main body having a pivotably mounting assembly; a pivotable sharpening steel having a mounting plate connected to the pivotable mounting assembly; and a U-shaped return spring positioned between the bracket and the mounting plate of the pivotable sharpening steel. While the stationary sharpening steel extends vertically above the top surface of the main body, the pivotable sharpening steel rotates with respect to the main body. When a user inserts a pair of scissors so that the inside surfaces of the two blades abut the opposed surfaces of the stationary sharpening steel, and the blades extend beyond the vertical sharpening steel positioned above and below the pivotable sharpening steel, the blades are closed against the pivotable sharpening steel to rotate the pivotable sharpening steel in a horizontal plane with respect to the main body to travel from its standby position along the blade cutting edges. The vertical sharpening steel provides stable alignment of the scissors with respect to the scissors sharpening apparatus and sharpens the interior of the cutting edges. When the scissors blades are disengaged from the scissors sharpening apparatus, the return spring will bias the pivotable sharpening steel back to its standby position to be ready for sharpening the next pair of scissors.

The pivotable sharpening steel extends at an upwardly inclined angle in a vertical plane from the pivotable mounting assembly attached to the main body in order to reduce choking of the scissors blades as the pivotable sharpening steel travels along their cutting edges during the sharpening operation. The bracket mounted to the main body can also pivot with respect to the main body so that the pivotable sharpening steel rotates in a vertical plane while it is also pivoting in the horizontal plane during the scissors sharpening operation tofurther reduce potential chocking of the pivotable sharpening steel along the scissors blades during the sharpening operation.

The pivotable sharpening steel preferably comprises a straight segment and two curved segments. If the first curved segment is bowed away from a longitudinal axis, while the second curved segment is bowed back towards the longitudinal axis, the pivotable sharpening steel produces a sharper cutting edge along the scissors blade. If the first curved segment is bowed towards the longitudinal axis, while the second curved segment bows away from the longitudinal axis, the pivotable sharpening steel produces a stronger finish to the sharpened cutting edge of the blade. Two sharpening apparati having these different curved configurations for the pivotable sharpening steel may be used sequentially to sharpen the cutting edges of the scissors blades, and then strengthen their finish.

In still another embodiment of the scissors sharpening apparatus, a horizontal niche may be formed within the top surface of the main body with the stationary sharpening steel being omitted. The horizontal niche is used to provide stable alignment of the scissors blades within the main body and with respect to the pivotable sharpening steel during the sharpening operation. The scissors blade cutting edges are sharpened by the pivotable sharpening steel as described above without the need to manipulate the scissors blades along a vertical stationary sharpening steel. This enables quicker engagement by the scissors blades with the sharpening apparatus to shorten the time required to sharpen their cutting edges.

The scissors sharpening apparatus may be conveniently accessed and used by a person using a scissors on a meat packing or factory assembly line, as well as less industrial settings like a barber, beautician, pet groomer, florist, or crafter. Moreover, the scissors sharpener apparatus may be used quickly and conveniently without reference to its position in three-dimensional space, because unlike prior art devices, gravity is not required to return the sharpening steel to its standby position after the pair of scissors is disengaged from the device.

For purposes of the present invention, "cut substrate" means a material such as hair, paper, cardboard, metal foil, thin plastic, textiles, cloth, silk, rope, twine, wire, wood veneers, wood, flowers, tree or plant part, or foods like meats that is capable of being cut or trimmed by a pair of scissors.

As used within this Application, "scissors" means a hand-operated shearing tool having a pair of metal blades pivoted between an opened and closed position with the blades sliding against each other by means of handles opposite to the pivot point. It includes, without limitation, conventional scissors, hair-cutting scissors for trimming hair, thinning scissors for thinning hair, blade shears for cutting animal's fleece to make wool, pet groomer's shears, hobby scissors for cutting or trimming cloth, paper, plastic, wood or other materials used in sewing or hobbies, hedge trimmers, gross shears, averruncators for trimming high branches from trees, pruning shears or secateurs for trimming small branches, loppers for cutting through large branches, metal or tin snips, scissors for separating meat from an animal carcass, kitchen scissors or shears for food preparation, poultry shears for cutting cooked poultry meat, cigar cutters for cutting the tip off a cigar, nail scissors, trauma shears for emergency medical responders to cut clothing off a victim, surgical scissors for cutting human or animal flesh during surgery, and bandage scissors for cutting bandages.

FIG. 1 shows a pair of scissors 10 cutting a cut substrate in the form of a sheet of paper 12 along an intended cut line 14. The produced cut line 16 is shown behind the travel path of the scissors.

Figure 2:
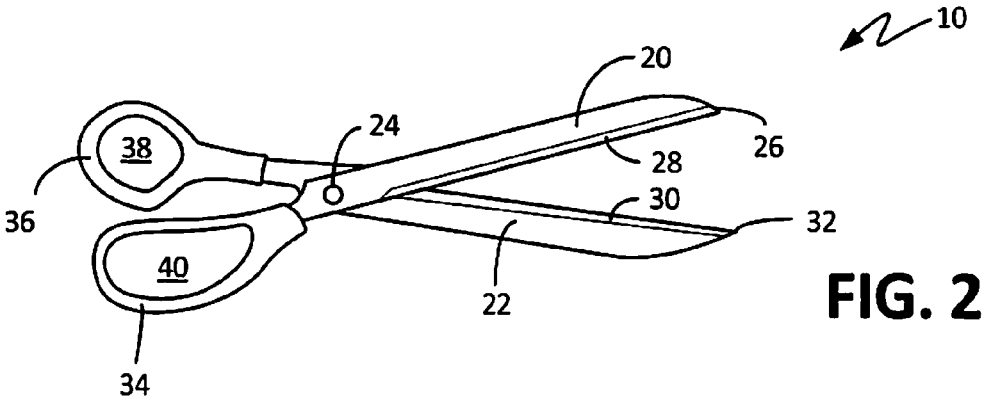
FIG. 2 is a perspective view of a pair of scissors in an opened position.

The pair of scissors 10 is a hand-operated shearing tool that is shown more clearly in FIG. 2. It consists of two metal blades 20 and 22 that are pivoted with respect to each other around a pivot point. A fastener 24 like a nut and bolt or rivet is used to secure the two blades together at this pivot point. Between this pivot point and the pointed tip 26 of blade 20 lies cutting edge 28 along its bottom blade surface. Likewise, cutting edge 30 lies along the top surface of blade 22 between the pivot point and its pointed tip 32. Attached to the opposite end of blades 20 and 22 are a pair of handles 34 and 36. For a right-handed person, the thumb is inserted through opening 38 in handle 36, while several fingers are inserted through opening 40 in handle 34. When the person moves his thumb apart from the fingers to move handles 34 and 36 away from each other, blades 20 and 22 will likewise move apart from each other to move the scissors to its opened position. When the person moves his thumb and fingers together to close handles 34 and 36 against each other, then blades 20 and 22 will likewise come together and slide against each other so that sharpened edges 28 and 30 cut paper substrate 12.

Figure 3:
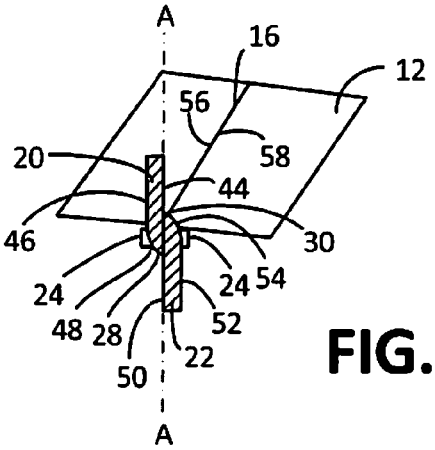
FIG. 3 is a cross-sectional view of the two blades of a pair of scissors in a partially closed position cutting the piece of paper.

FIG. 3 represents a cross-sectional view of scissors 10 with blade 20 and blade 22. Blade 20 has a flat inside surface 44, outside surface 46, beveled edge 48 in between and along the bottom surface of the blade, and cutting edge 28 defined by the point where beveled edge 48 meets inside surface 44. Similarly, blade 22 has flat inside surface 50, outside surface 52, beveled edge 54 in between and along its top surface, and cutting edge 30 defined by the point where beveled edge 54 meets inside surface 50. When the scissors 10 is moved by the user to its closed position, blades 20 and 22 pivot so that inside surfaces 44 and 50, respectively, slide against each other with cutting edges 28 and 30 piercing paper 12 along the length of the portions of the blades that engage the paper. Beveled edges 48 and 54 of blades 20 and 22 act to push the cut edges 56 and 58 of the paper along cut line 16 away from each other to assist the cutting action of the scissors blades as they progress through paper substrate 12.

Figure 4:
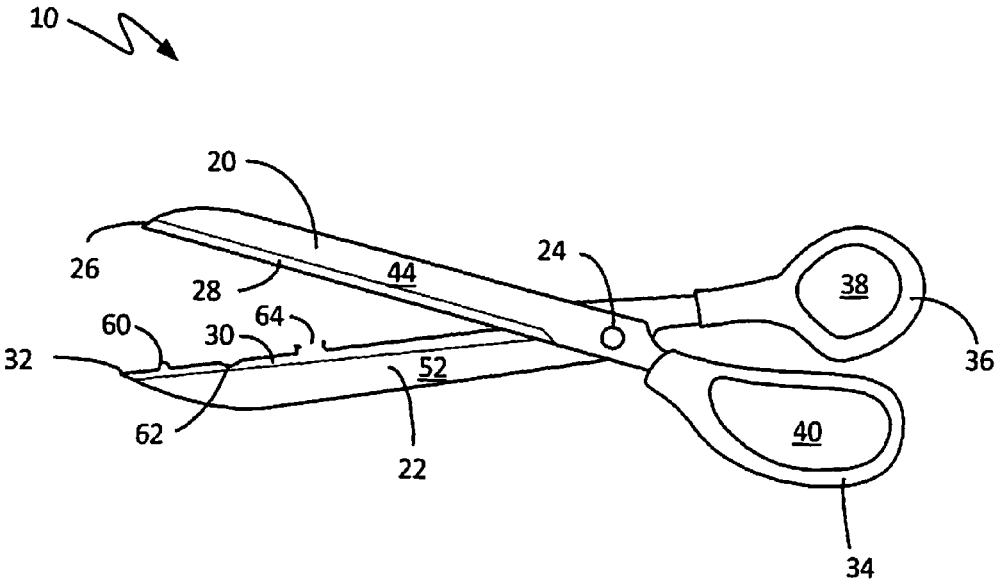
FIG. 4 is a perspective view of a pair of scissors in an opened position with deformed edges and burrs along the blade.

Thus, it is cutting edge 28 and 30 on the blades 20 and 22 that need to be maintained in a sharpened state. As shown more clearly in FIG. 4, cutting edge 30 along scissors blade 22 should be maintained in a state with a continuous, straight edge along the length of the blade. But through usage, especially if the scissors 10 are employed to shear a tough or abrasive cutting material 12, portions of the cutting edge may become deformed. Such deformation in the blade cutting edge 30 may create an inwardly deflected region 60 deviating towards vertical line A-A shown in FIG. 3. Alternatively, such deformations in the blade cutting edge may create an outwardly deflected region 62 deviating away from vertical line A-A. Such deformations cause a "dulled edge" along the scissors blade that yields a poor cut by the scissors. Even more critically, a deformed region along the scissors blade may become worse in its deflection over time to the point that its metal separates from the scissors blade to form a burr 64 along the blade. Such inwardly deflected deformations 60 and burrs 64 can impede the scissors blades 20 and 22 from smoothly gliding past each other along their interior faces 44 and 50 to prevent the scissors from being opened and closed. Moreover, the inwardly deflected deformations 60, outwardly deflected deformations 62, and burrs 64 along the scissors blade will crush the cut material 12 adjacent to cut line 16 as the scissors cut, instead of slicing or shearing the material with a neat and uniform cut line. Furthermore, if the scissors 10 is used to cut hair, the deformations and burrs may pull or crush the hair to produce pain and split ends in the person whose hair is being cut. Likewise, if the scissors are used to cut the stem of, e.g., a rose, these deformations and burrs can crush the cut edge of the stem to make the rose susceptible to disease and shorten the life of the flower.

While a piece of paper 12 has been shown as the piece of cut material sheared by the scissors for the sake of illustration, a number of other types of cut material like hair, flowers, cardboard, metal fork, plastic, textiles, cloth, silk, rope, twine, wire, wood veneers, tree or plant parts, or meat or other foods are commonly sheared by scissors, and should be understood as being fully covered by the scope of this invention.

Figure 5:
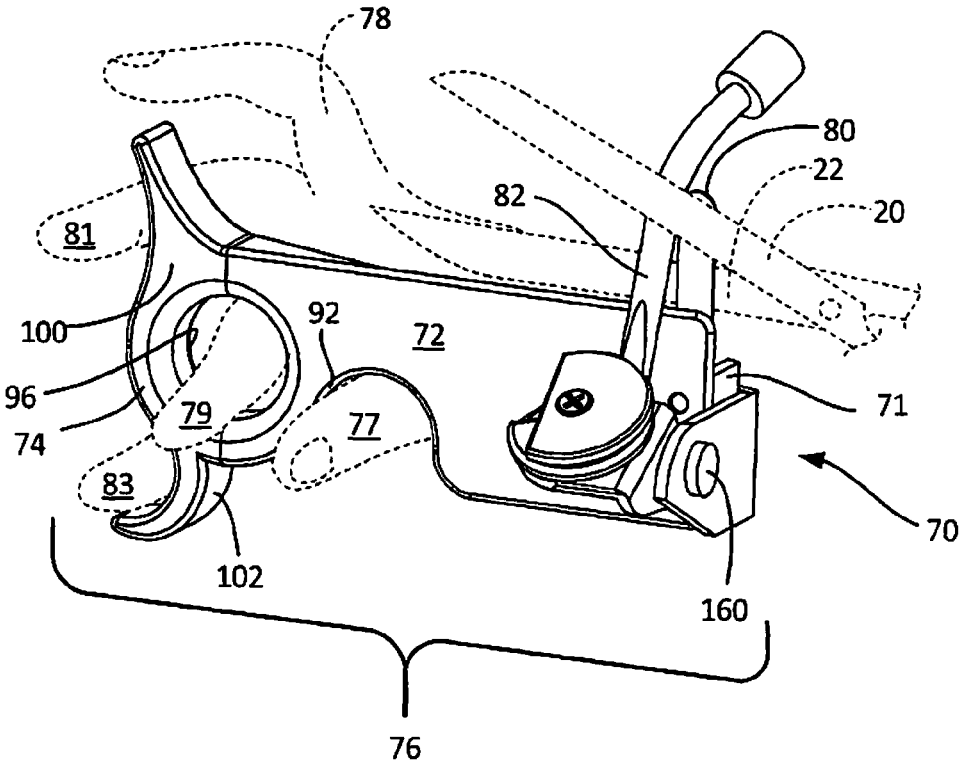
FIG. 5 is a perspective view of the scissors sharpening device of the present invention with the user's hand and scissors blades shown in phantom lines.

The scissors sharpener 70 of the present invention is shown in FIG. 5. It comprises a main body 72 having a first end 71 and a second end 73, and end body portion 74 that combine to provide a body assembly 76 that is held by the user's hand 78. The blades 20 and 22 of scissors 10 are moved by the user's other hand (not shown) along vertical sharpening steel 80 and pivoting sharpening steel 82 to sharpen them.

Figure 6:
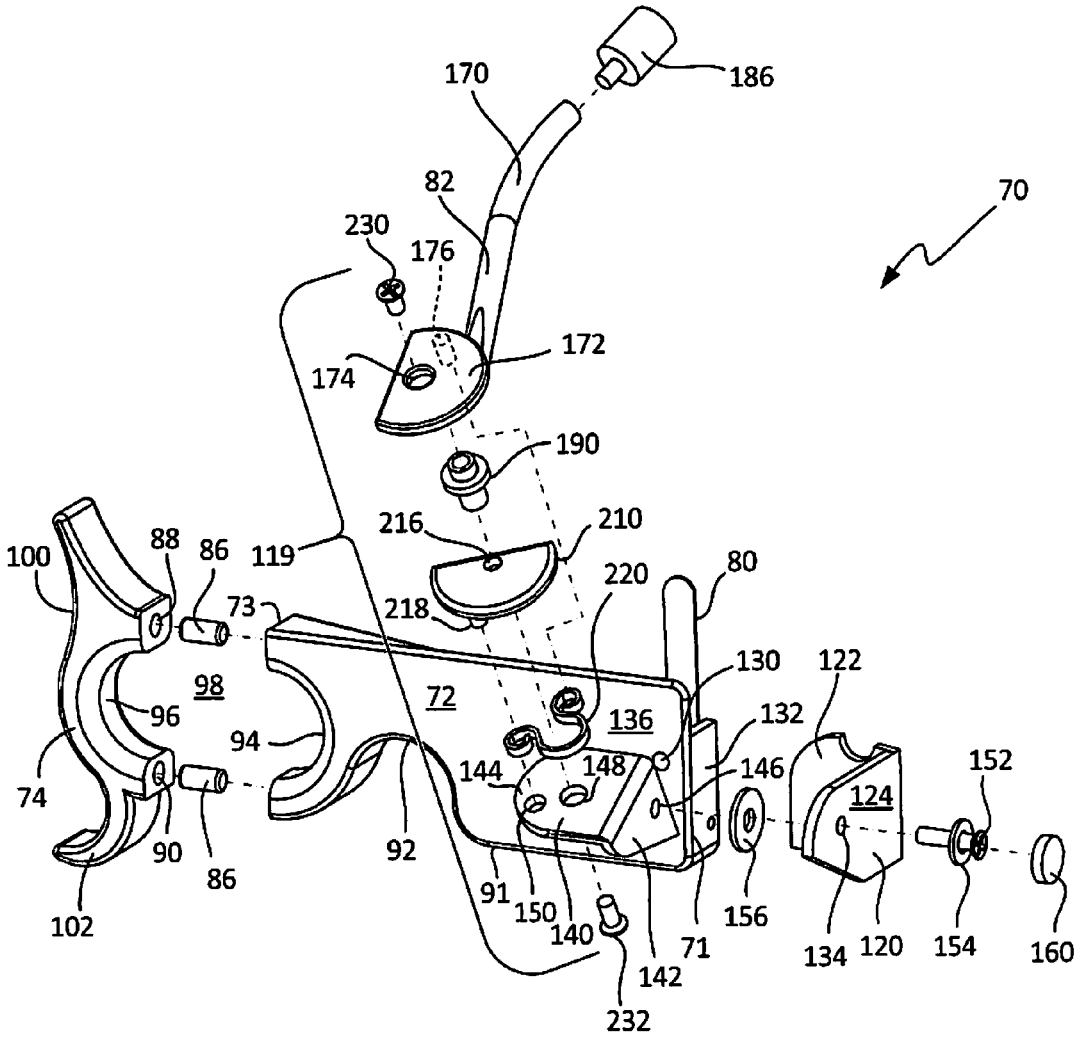
FIG. 6 is an exploded view of the scissors sharpener of FIG. 5.

As shown more clearly in FIG. 6, end body portion 74 may be connected to the distal end 73 of main body portion 72 by means of a plurality of connectors such as dowel pins 86 that are inserted into apertures 88 and 90 formed within the end body portion 74 and corresponding apertures (not shown) formed within main body portion 72. Other means such as screws or bolts and corresponding threaded holes, or adhesives or welding may be used instead to connect the two body portions together. A single, unitary body may also be employed. By using two separate body portions, however, the end body portion 74, e.g., may be manufactured from a different material than the material used for the main body portion 72, or a different color than the color imparted to the main body portion to enhance the decorative appearance of the scissor sharpener 70.

Formed within the bottom surface 91 of main body 72 is indented, contoured surface 92 that may be grasped by the user's thumb 77. Meanwhile, semi-circular surfaces 94 and 96 formed within main body 72 and end body 74 portions, respectively, cooperate to form aperture 98 through which the user may insert her middle finger 70. Finally, the opposite end surface 100 of end body portion 74 is contoured for being grasped by other fingers 81 of the user. A curved trigger 102 may also extend downwardly from end body portion 74 for being grasped by the user's ring finger 83. In this marmer, the user can firmly and securely grasp the body assembly 76 of scissors sharpener 70 by her hand 78 to hold it in a stationary position while sliding the scissors blades 20 and 22 along the sharpening steels 80 and 82.

Figure 7:
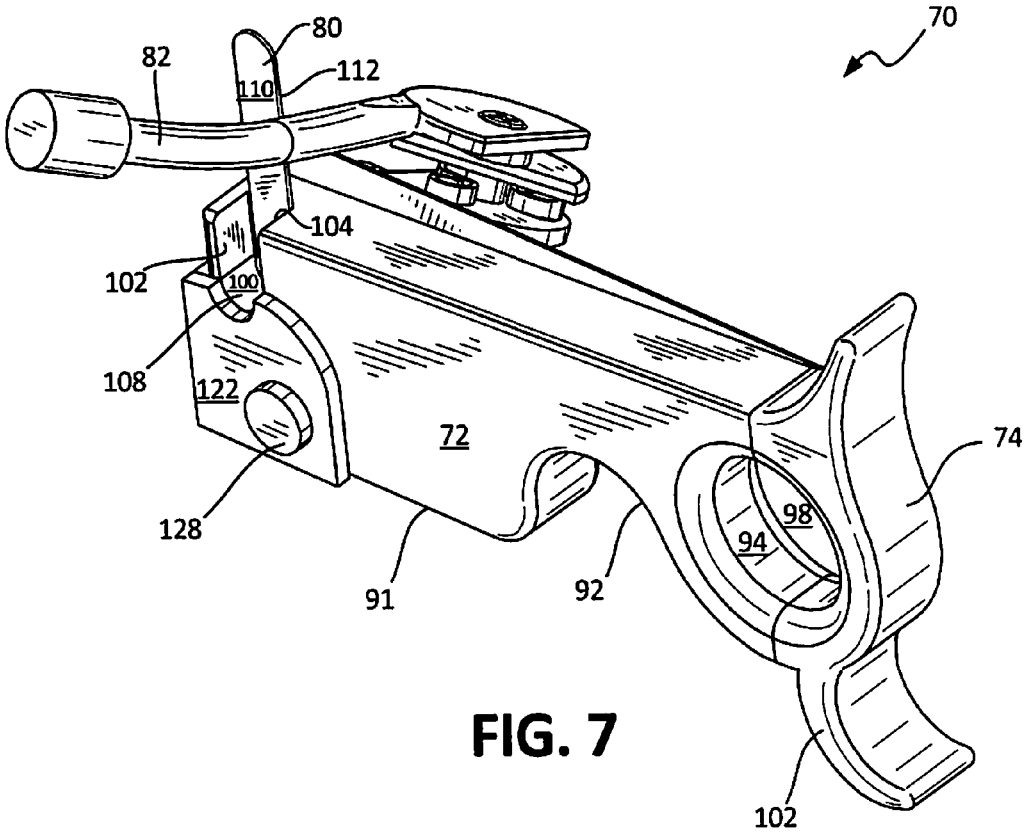
FIG. 7 is a perspective view of the scissors sharpener of FIG. 5 from the opposite point of view.
Figure 8:
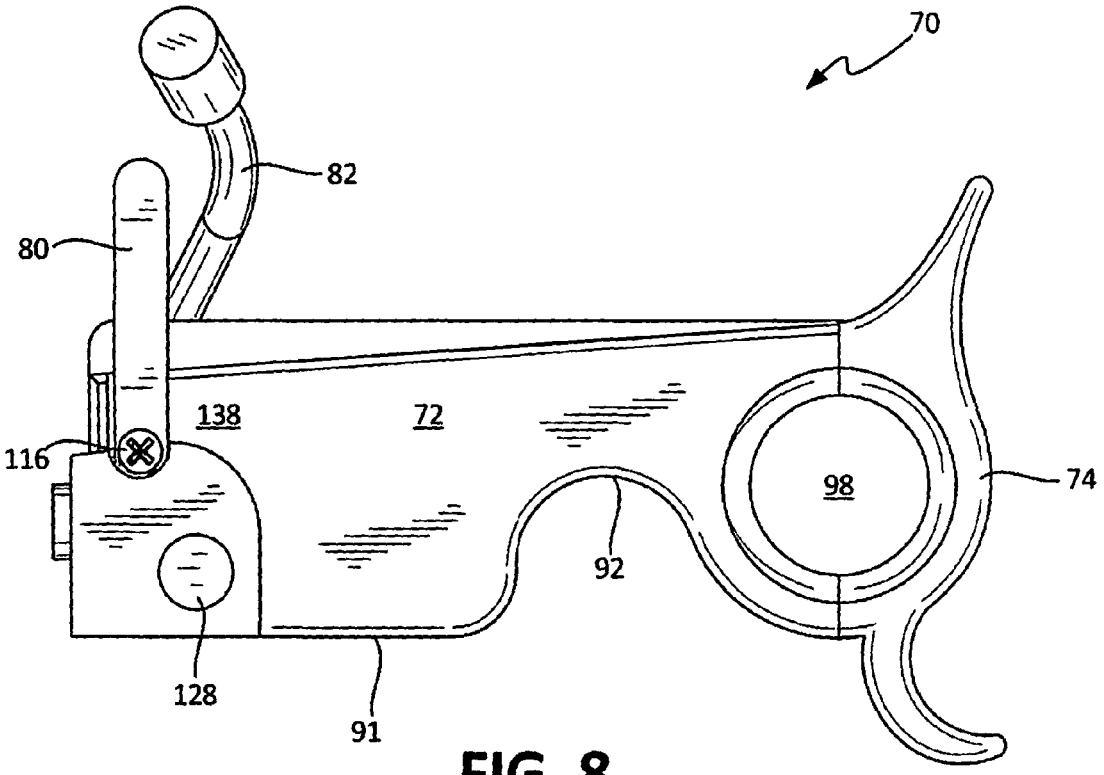
FIG. 8 is a left side elevational view of the scissors sharpener of FIG. 5.

The first end 71 of main body 72 provides attachment surfaces for the stationery sharpening steel 80 and pivotable, curved sharpening steel 82. As shown more clearly in FIGS. 7-8, main body 72 contains a recessed niche 100 defined by side walls 102 and 104, back wall 106 (not shown), and bottom wall 108.

Stationary sharpening steel 80 represents a honing steel, sometimes referred to as a "sharpening steel", "sharpening rod", "sharpening stick", or (in the food or cooking industry) a "butcher's steel" or "chef's steel." It comprises a rod made from hardened steel, stainless steel or stainless steel alloy, diamond-coated steel, or ceramic. In the case of stationery sharpening steel 80, it bears a flat cross-section characterized by two opposed faces 110 and two opposed edge surfaces 112. When made from a carbon-containing stainless steel material like 440C alloys (sourced, e.g., from Discount Steel of Minneapolis, Minn.) or ceramic, it bears a smoothly, highly polished surface. Optionally, it may include a plurality of longitudinal ridges. When made from diamond-coated steels, the steel material is embedded with abrasive diamond particles. Suitable diamond-coated steel or ceramic materials may be sourced from Saint-Gobain Corporation of Courbevoie, France. But, the material from which the stationary sharpening steel 80 is fabricated must have a higher tensile strength than the metal from which the blades 20 and 22 of scissors 10 are made, or else be treated to a surface hardening process. In this marmer, the functional performance of the stationary sharpening steel 80 is to realign a deformed edge 62 or 64 of the scissors blade when its length is moved along the sharpening steel 80, rather than to remove metal from the scissors blade edge. When pressure is applied on the scissors blade against the hard sharpening steel, it will cause the blade's metal to yield to the harder sharpening steel metal or ceramic material to become realigned and sharpened. Yet, the steel surface must be super smooth in order to avoid further damage and deformation caused by the sharpening steel for the scissors blade that could create unwanted burrs along the blade edge. Thus, the stationary sharpening steel does not function like a grinding wheel, whetstone, or hone that is commonly used to remove metal burrs from a blade before it can be sharpened.

Stationary sharpening steel 80 is fitted inside niche 100 formed within main body 72. A bolt or other fastener 116 is inserted through a hole (not shown) formed through the main body 72 secured at its other end by a nut (not shown). The width of opposed faces 110 of stationary sharpening steel 80 should substantially match the width of back wall 106 of niche 100 formed within main body 72 of the scissors sharpener 70. At the same time, the width of edge surfaces 112 should be substantially less than the width of side walls 102 and 104 of the niche. In this matter, stationary sharpening rod 80 fits in vertical orientation inside niche 100, so that its movement is arrested by side walls 102 and 104 as scissors blades are moved along the opposite faces 110 of the sharpening steel. Thus, sharpening steel 80 remains substantially stationary during use of the scissors sharpener 70.

Returning to FIG. 6, attached to the left side 136 of the main body 72 of the scissors sharpener 70 is the pivotable, curved sharpening steel assembly 119. It includes an L-shaped anchor bracket 120 that is connected to the lower right-side region 138 of main body 72. This anchor bracket has vertically disposed panels 122 and 124 which are joined to each other at a roughly perpendicular angle. Panel 122 has a hole 126 (not shown) formed therein for accommodating a bolt or other fastener 128 (see FIG. 7) which is inserted through hole 126 in panel 122, a corresponding round charmel 130 (not shown) formed within main body 72, and secured by a nut 131 (not shown) along the left-hand side 136 of the main body. In this marmer, panel 122 of anchor bracket 120 is secured to the right-hand side of main body 72 with panel 124 extending in roughly parallel relationship across the front side surface 132 of the main body. Hole 134 (see FIG. 6) is formed within panel 124 in a position that extends beyond the left-hand side 136 of the main body.

Pivot base plate 140 constitutes an L-shaped bracket having panels 142 and 144 that are joined together in roughly perpendicular relation to each other. Panel 142 is vertically disposed and contains aperture 146. Panel 144 contains aperture 148 near its center and aperture 150 at a peripheral location on the panel (see FIG. 6). Bolt or other fastener 152 passes through aperture 134 in anchor bracket 120 and aperture 146 in pivot base plate 140 in conjunction with washer 154 and washer 156 and is secured at its other end by nut 158 (not shown) to connect the pivot base plate to the anchor bracket and in turn main body 72 of the scissors sharpener. Decorative cap 160 may be used to conceal bolt head 152. When attached, panel 144 of pivot base plate is positioned at an upwardly inclined angle with respect to the vertical side panel 136 of the main body 72. Moreover, this panel 44 may pivot up and down as the pivot base plate 140 rotates around the pivot axis provided by bolt fastener 152.

Pivotable sharpening steel 82 comprises a curved sharpening steel arm 170 that is connected to pivot arm plate 172. This curved sharpening steel arm 170 and pivot arm plate 172 may be separate parts, or they may be one unitary part. Pivot arm plate 172 represents a flat, semi-circular piece having aperture 174 formed therein, and a cylindrical boss 176 extending downwardly from the plate.

Sharpening steel arm 170 comprises a rod of steel or stainless steel, ceramic, or diamond-coated steel that is round or oval in cross-section. The length of the scissors blade determines the necessary length of the curved sharpening steel arm 170. For example, scissors with six-inch long blades will require a curved sharpening steel arm that is approximately 3¼ inches long. A longer curved sharpening steel arm is required for scissor blades longer than six inches. At the same time, the curved regions on the sharpening steel arm 170 enable the sharpening steel arm to project a shorter lateral distance from pivot arm plate 170, while still providing necessary exterior surface area along which the scissors blades can travel during the sharpening process, than would be the case if the sharpening steel 170 was entirely straight.

Like stationary sharpening steel 80, curved sharpening steel over 170 can be made from a hardened steel, stainless steel or stainless steel allow, diamond-coated steel, or ceramic material. It is preferably made from a carbon-containing stainless steel material like 440C alloy (sourced, e.g. from Discount Steel of Minneapolis, Minn.) with a super smooth finish. It optionally may include a series of longitudinal ridges around its exterior surface.

Figure 9:
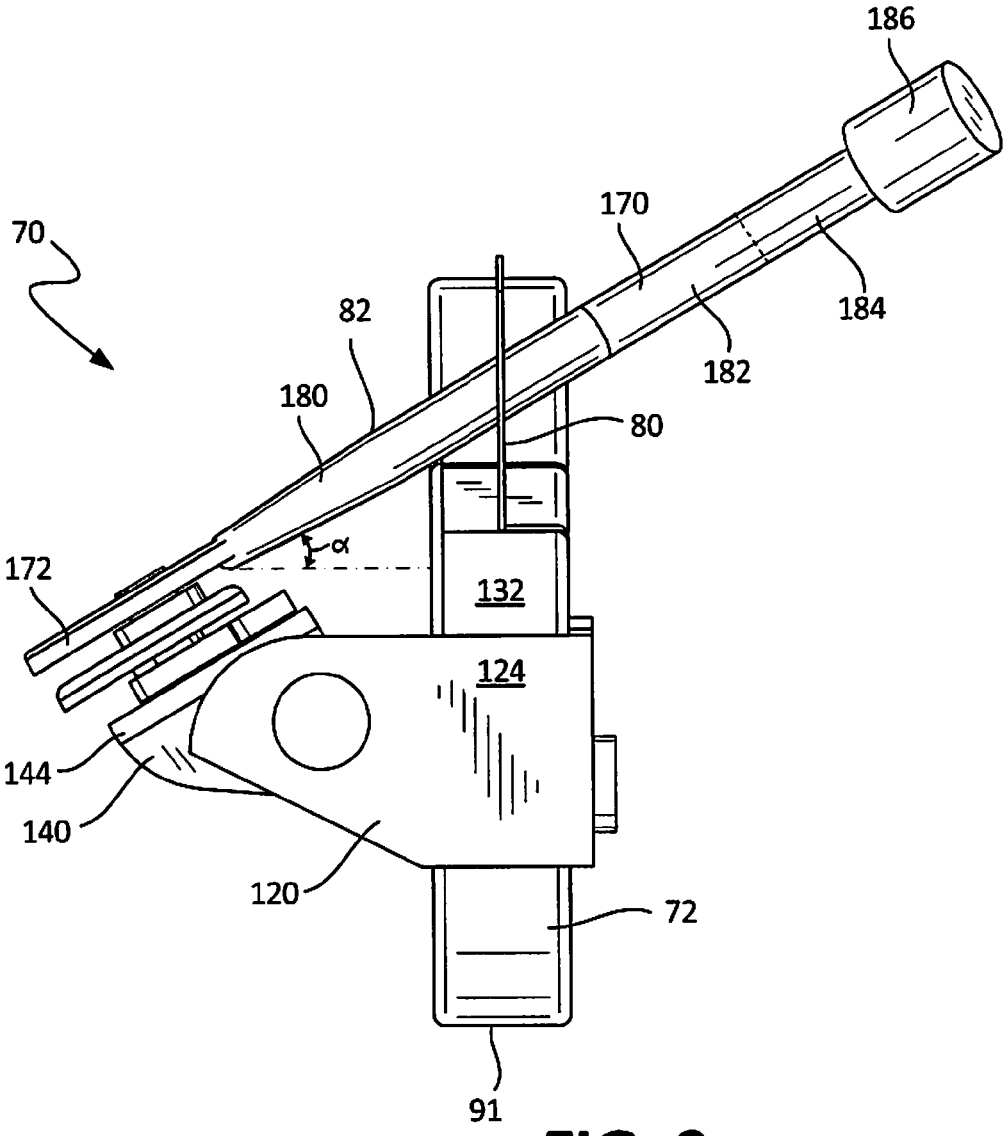
FIG. 9 is a front elevational view of the scissors sharpener of FIG. 5.
Figure 10:
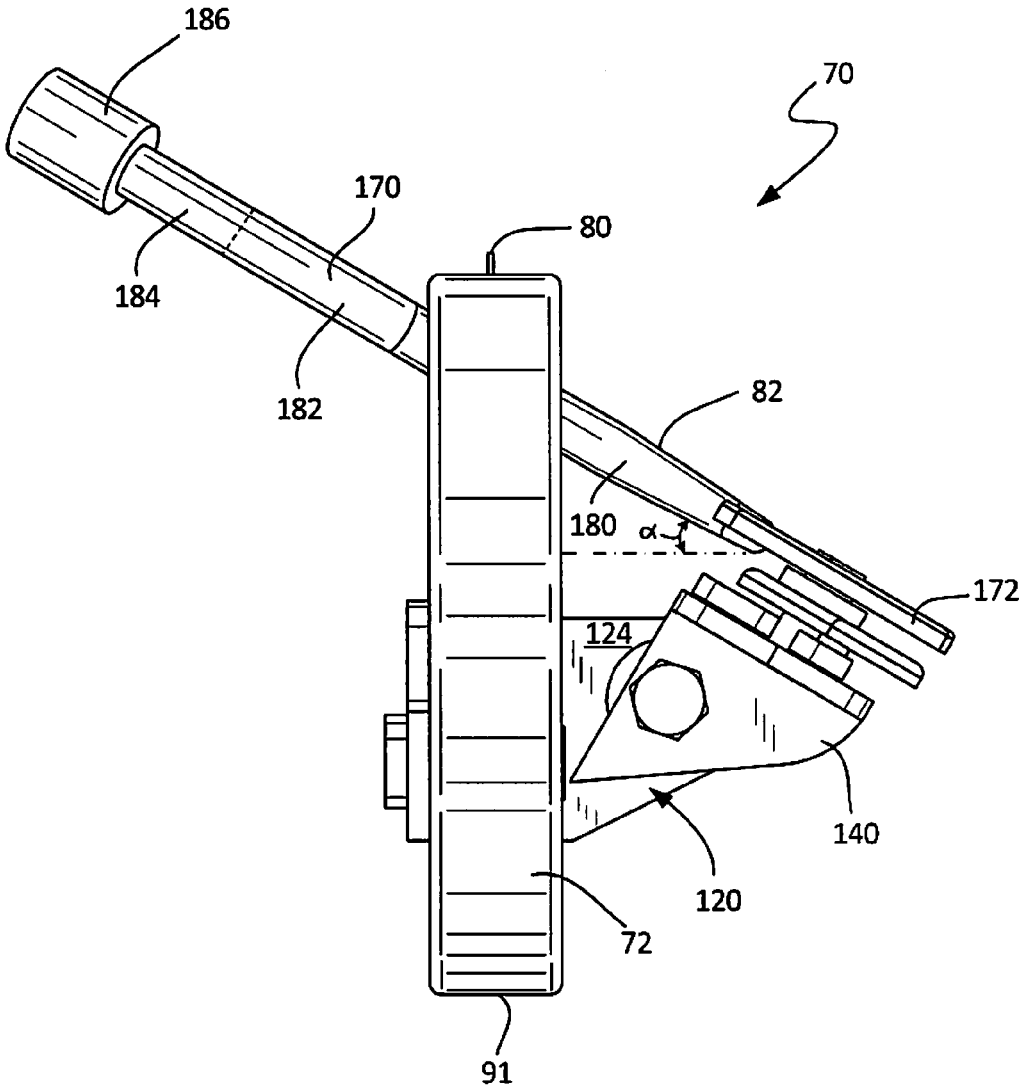
FIG. 10 is a back elevational view of the scissors sharpener of FIG. 5.

As shown more clearly in FIGS. 9-10, the curved sharpening steel arm 170 of pivotable sharpening steel 82 is roughly co-planar with the pivot arm plate 172. When pivotable sharpening steel 82 is attached to pivot base plate 140, the upwardly inclined angle of pivot base plate 140 will cause sharpening steel arm 170 to extend at an upward incline in a vertical plane from the left side of the scissors sharpener 70 past the right side, forming an angle $\alpha$ of approximately 20-50 degrees, preferably 30-45 degrees, formed between the lower surface of the sharpening steel arm 170 and a line parallel to the bottom surface 91 of main body 72.

Figure 11:
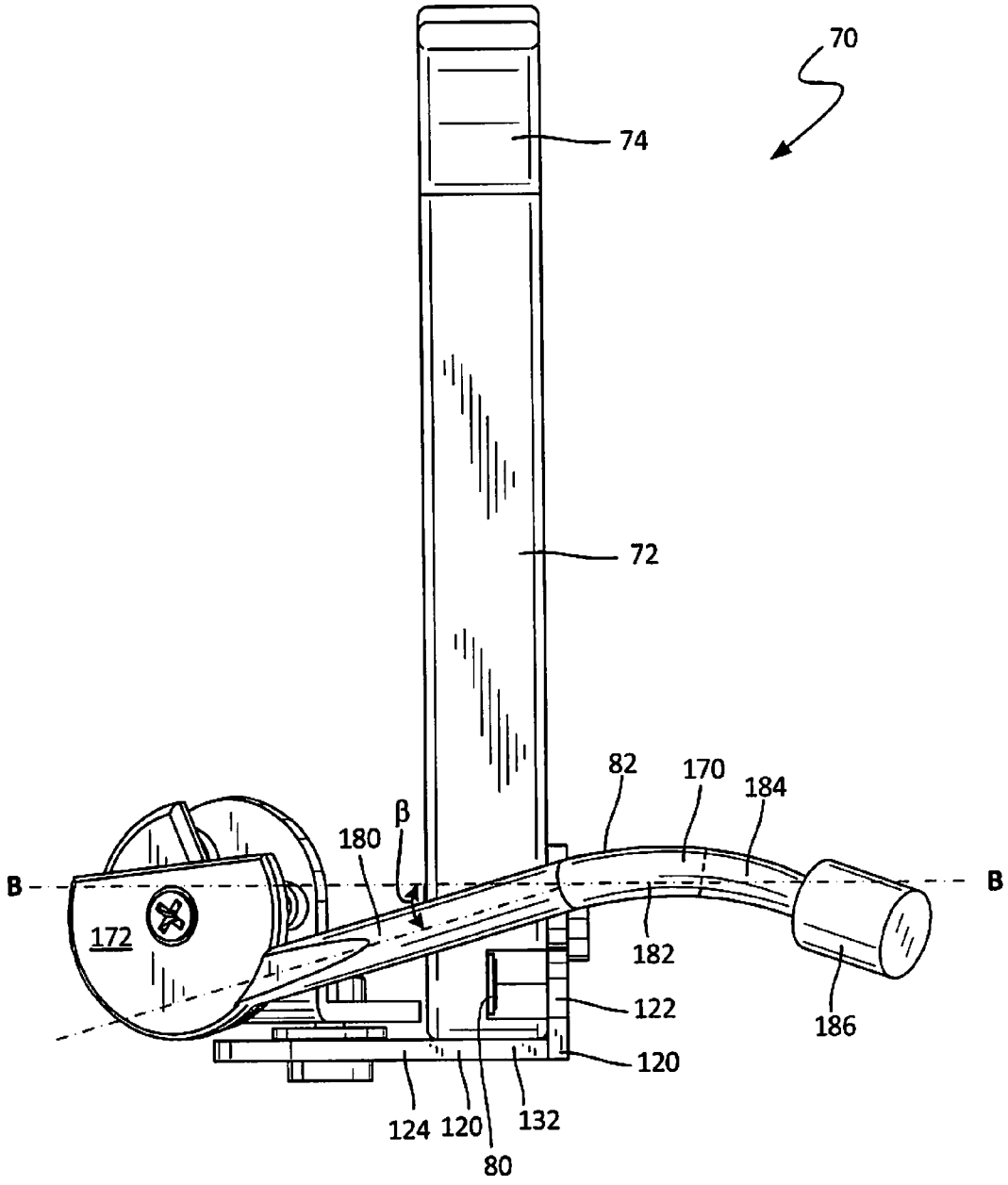
FIG. 11 is a top plan view of the scissors sharpener of FIG. 5.

FIG. 11 presents a top plan view of scissors sharpener 70 showing the curved sharpening steel arm 170 in a horizontal plane. Longitudinal axis B-B roughly parallel to the front surface 132 of main body 72 of scissors sharpener 70 is also depicted. The sharpening steel arm 170 comprises three segments. First, a relatively straight segment 180 extends from pivot arm plate 172 at an angle $\beta$ with respect to longitudinal B-B. Straight segment 180 passes over the top of the main body 72 of the scissors sharpener when the pivotable sharpening steel 82 is in its standby position shown in FIG. 11. This relatively straight segment 180 turns into an outwardly bowed segment 182 with respect to the longitudinal axis B-B. Finally, this outwardly bowed segment 182 of the sharpening steel arm 170 turns into a bowed-back region 184 that turns in an arc back towards the front end 132 of the main body 172 and away from longitudinal axis B-B. An end cap 186 is attached to the end of this bowed-back region 184 of the sharpening steel arm 170 to provide an end-point for travel of the scissors blades 20 and 22 along the sharpening steel arm 170 during the sharpening operation.

Figure 12:
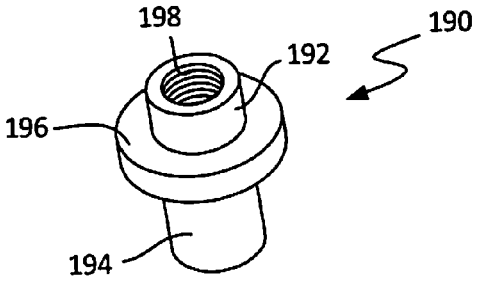
FIG. 12 is a perspective view of the pivot sleeve for the scissors sharpener.

Turning to FIGS. 6 and 12, pivot sleeve 190 has an armular upper housing 192 and armular lower housing 194 with a collar 196 between the two housings. The collar has a larger diameter than that of the two housings. The interior surface 198 of armular upper housing is threaded. The interior surface 200 of armular lower housing is also threaded (not shown).

Figure 13:
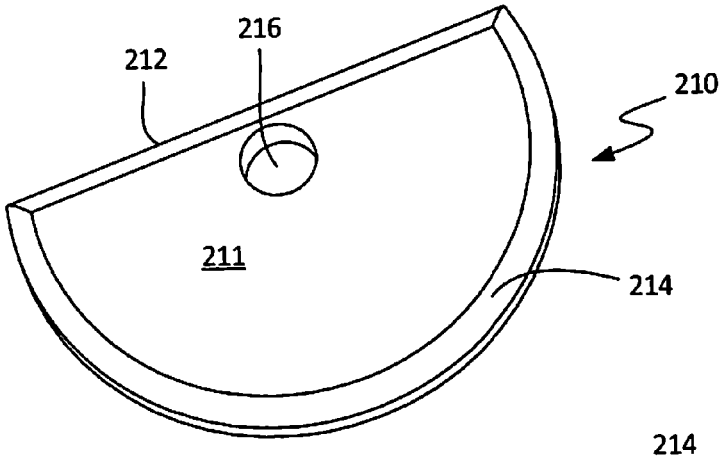
FIG. 13 is a perspective view of the top surface of the spring anchor plate for the scissors sharpener.
Figure 14:
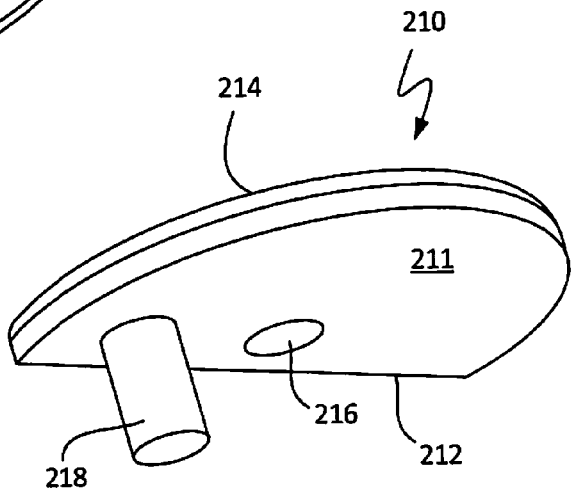
FIG. 14 is a perspective view of the bottom surface of the spring anchor plate of FIG. 13.

Spring anchor plate 210 is shown in FIGS. 6 and 13-14. It comprises a semi-circular, flat panel 21 having a straight edge 212 and a circular edge 214. Aperture 216 is formed in panel 211 near straight edge 212. Extending downwardly from the bottom surface of panel 211 is cylindrical boss 218.

Figure 15:
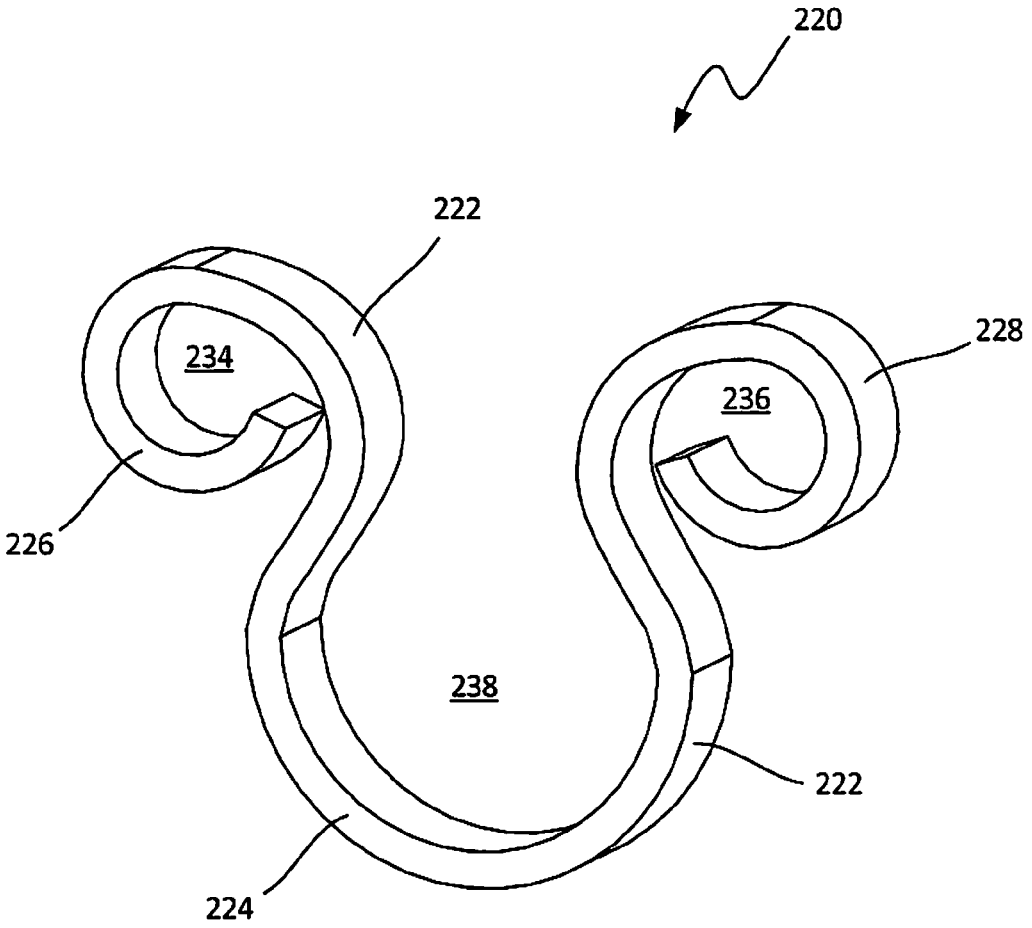
FIG. 15 is a perspective view of the return spring of the scissors sharpener.
Figure 16:
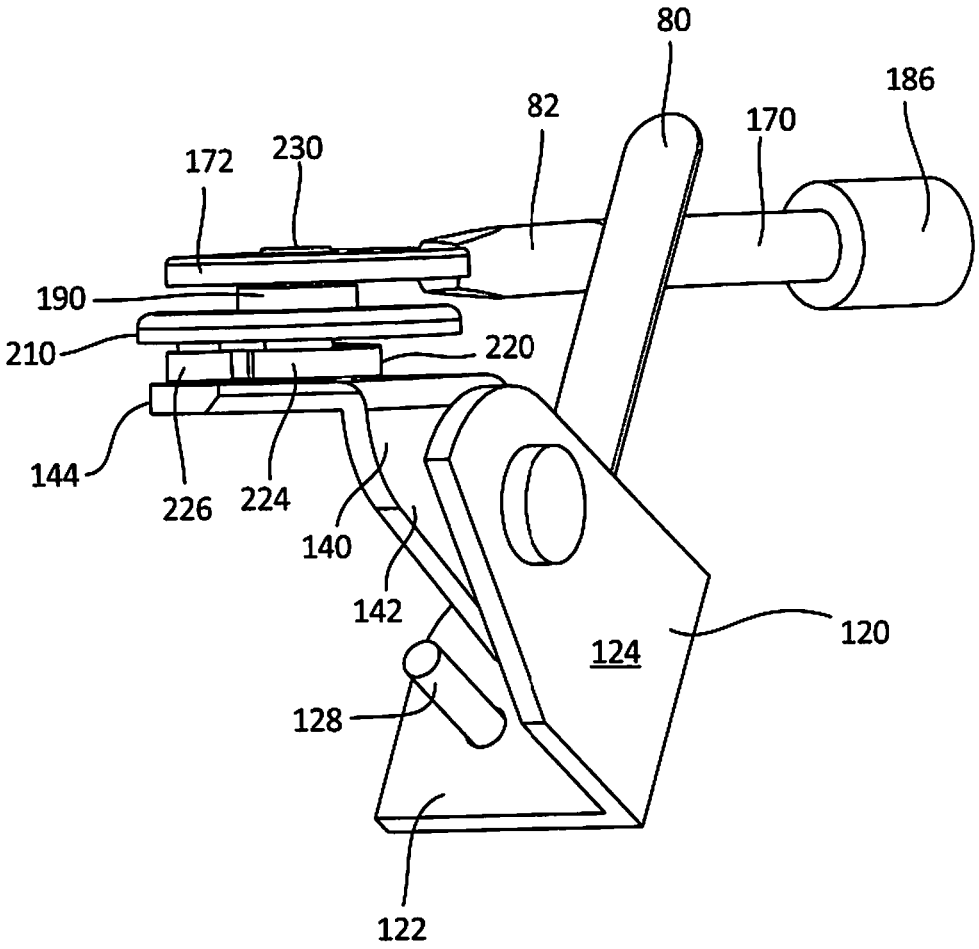
FIG. 16 is a perspective view of the curved sharpening steel assembly, stationary sharpening steel, and anchor bracket portions of the scissors sharpener of FIG. 5.
Figure 17:
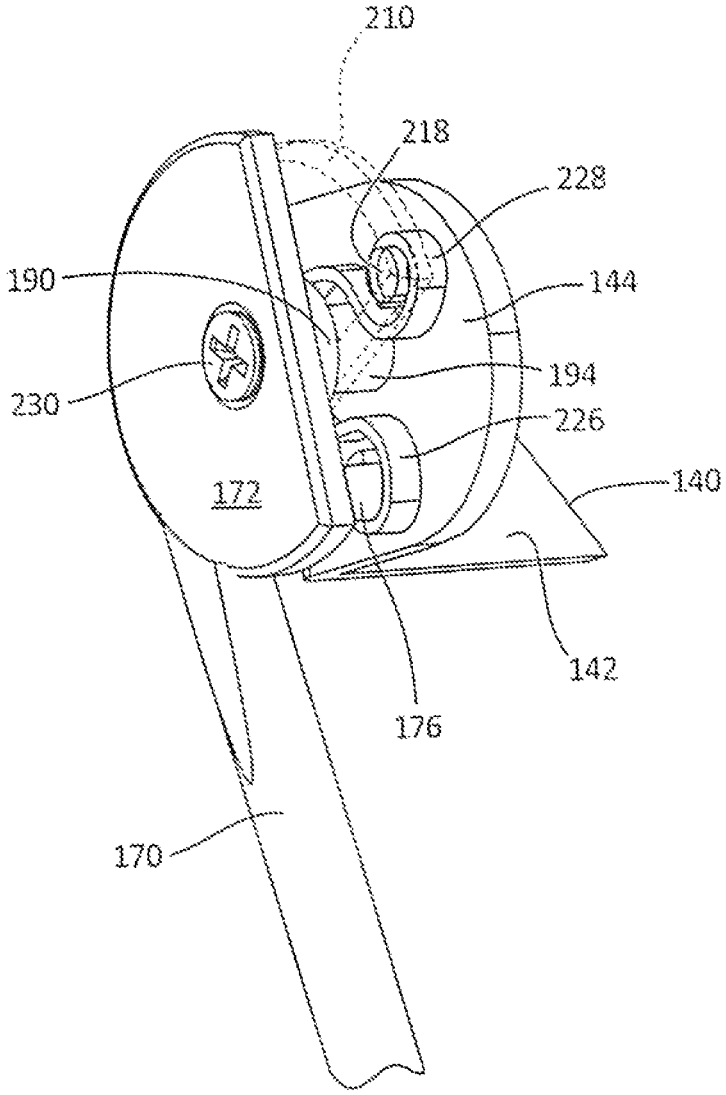
FIG. 17 is a perspective view of the curved sharpening steel assembly of FIG. 16 with the spring anchor plate shown in phantom lines.
Figure 18:
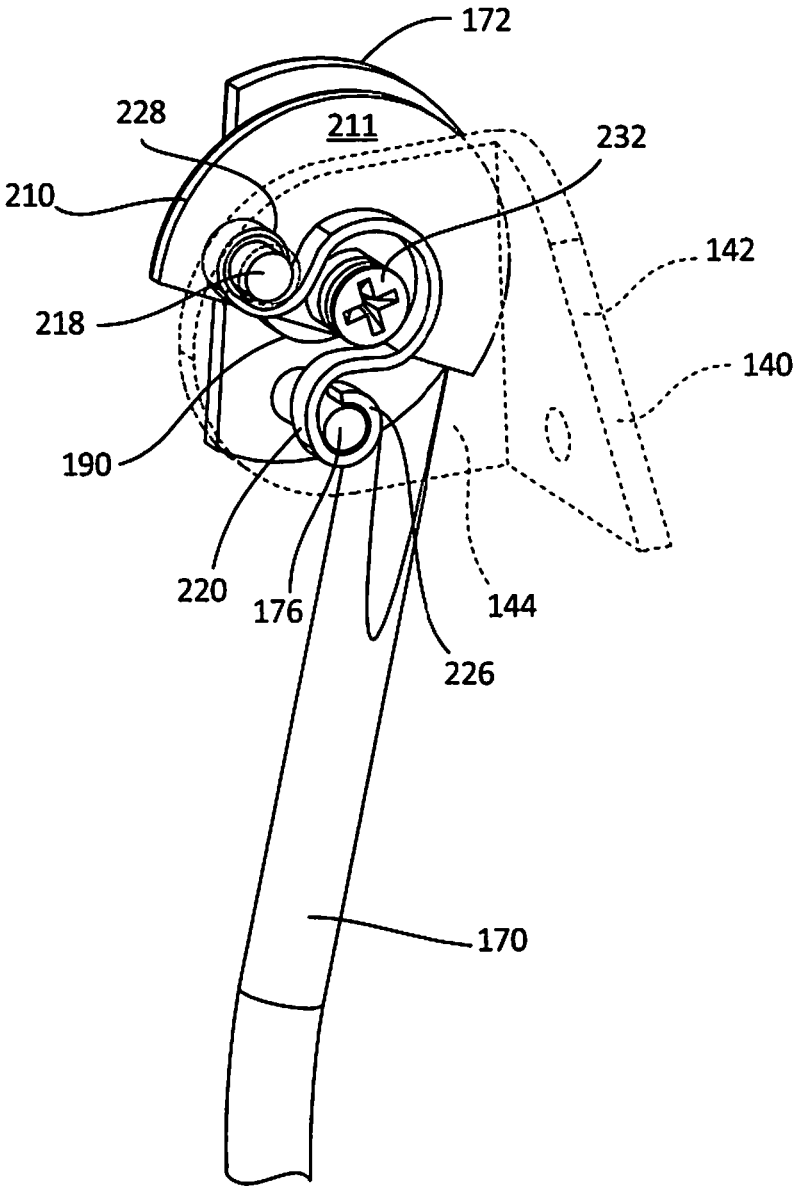
FIG. 18 is a perspective view of the curved sharpening steel assembly of FIG. 16 with the anchor bracket shown in phantom lines.
Figure 19:
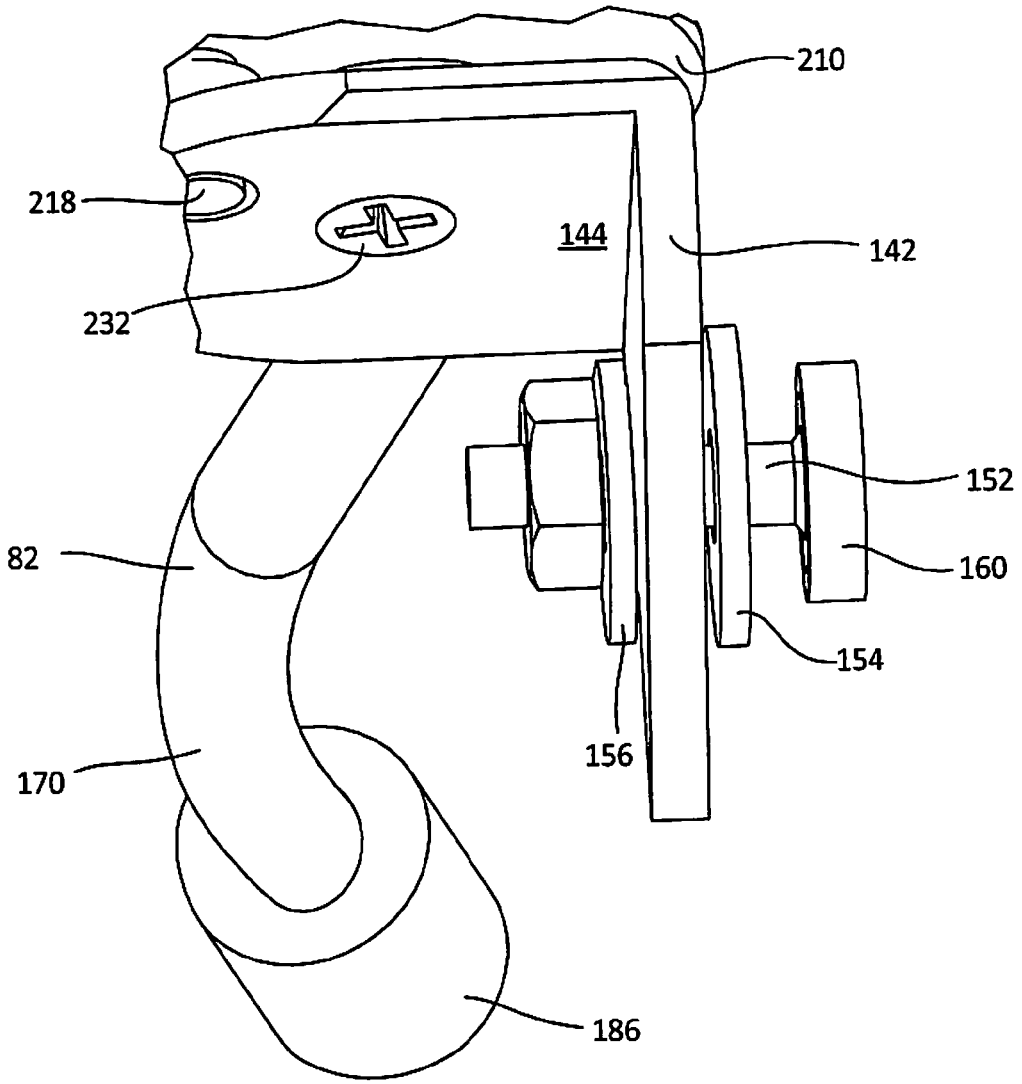
FIG. 19 is a perspective view of the anchor bracket assembly with the spring anchor plate attached to it.

Return spring 220 is shown in FIGS. 6 and 15. It comprises a U-shaped, curved strip 222 of metal material having the required combination of rigidity and elasticity to act like a spring. Central segment 224 is partially circular. First ear segment 226 comprising a nearly closed circle is connected to one end of the U-shaped central section 224. Second ear segment 228 also comprising a nearly closed circle is attached to the other end of the central section of the spring 220. Such a return spring is made from "spring steel" material which may be sourced from W. W. Grainger, Inc. of Lake Forest, Ill., or McMaster-Carr Supply Company of Elmhurst, Ill.

In the assembled state of the pivotable sharpening steel assembly 119 (see FIG. 6), curved pivot arm plate 172 of pivotable sharpening steel 82 is positioned above pivot sleeve 190, which in turn is positioned above spring anchor plate 210. Return spring 220 is positioned between spring anchor plate 210 and upwardly inclined panel 144 of pivot base plate 140 which is connected to the main body 72 of scissors sharpener 70 by means of anchor bracket 120. Upper armular housing 192 of pivot sleeve 190 is inserted through aperture 174 in pivot arm plate 172 with bolt 230 screwed through aperture 174 from the top face of the pivot arm plate into engagement with internal threaded surface 198 of the pivot sleeve (see FIG. 12).

Meanwhile, lower armular housing 194 of pivot sleeve 190 is inserted through aperture 216 in spring anchor plate 210 (see FIGS. 13-14), through the circular region 238 of return spring 220 defined by central segment 224, and through aperture 148 in upwardly inclined panel 144 of pivot base plate 140 (see FIG. 6). Bolt 232 is screwed through aperture 148 from the bottom face of panel 144 into engagement with interior threaded surface 200 (not shown) of the lower armular housing 194 of the pivot sleeve 190.

Boss 218 which extends downwardly from the bottom face 211 of spring anchor plate 210 (see FIG. 14) passes through the open region 234 formed by first ear segment 226 of return spring 220, and then through aperture 150 (see FIG. 6) in upwardly inclined panel 144 of pivot base plate 140. In this marmer, boss 218 provides an anchor point for the first ear segment end of the return spring 220.

Meanwhile, boss 176 which extends downwardly from the bottom face of pivot arm plate 172 bypasses spring anchor plate 210, extending past straight edge 212 of the spring anchor plate 210, and then passes through region 236 formed by second ear segment 228 of the return spring 220. The distal end 240 of boss 176 abuts the top surface of panel 144 of pivot base plate 140 without being secured to it.

Figure 20A:
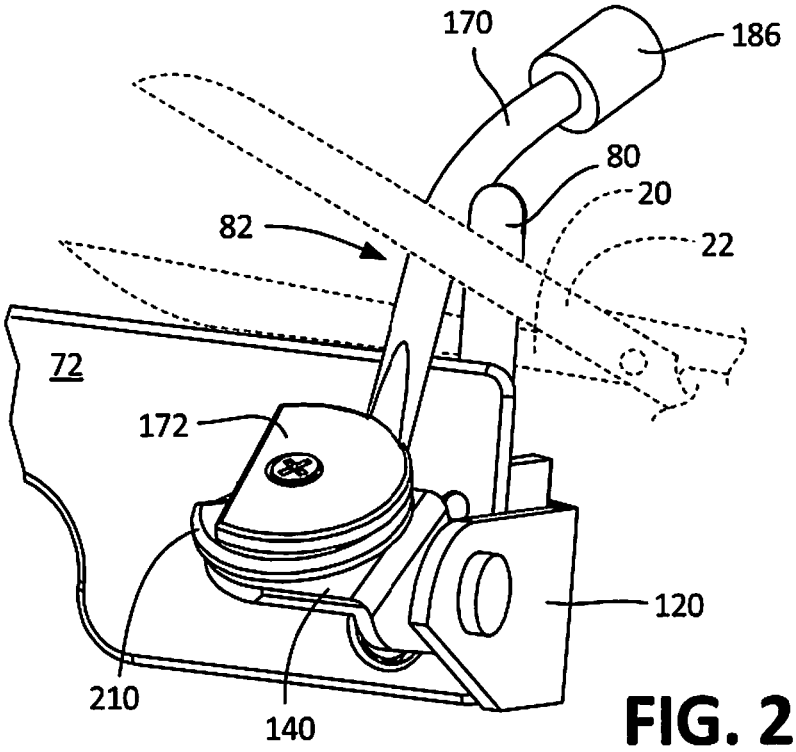
FIG. 20A is a partial perspective view of the scissors sharpener of FIG. 5 with the scissor blades starting the sharpening process.

Turning to FIG. 20A, the pivotable sharpening steel 82 is shown in its standby position with its curved sharpening steel arm 170 abutting or closely adjacent to stationary sharpening steel 80. As seen in FIG. 9, the upwardly inclined angle $\alpha$ of the curved sharpening steel 170 is approximately 20-50 degrees in the vertical plane, preferably 30-45 degrees. A pair of scissors 10 is inserted with the interior faces 44 and 50 of blades 20 and 22 abutting exterior flat surfaces 110 of vertical stationary sharpening steel 80 with blade 20 above curved sharpening steel arm 170 and blade 22 below the curved sharpening steel arm (see FIG. 20A).

Figure 20B:
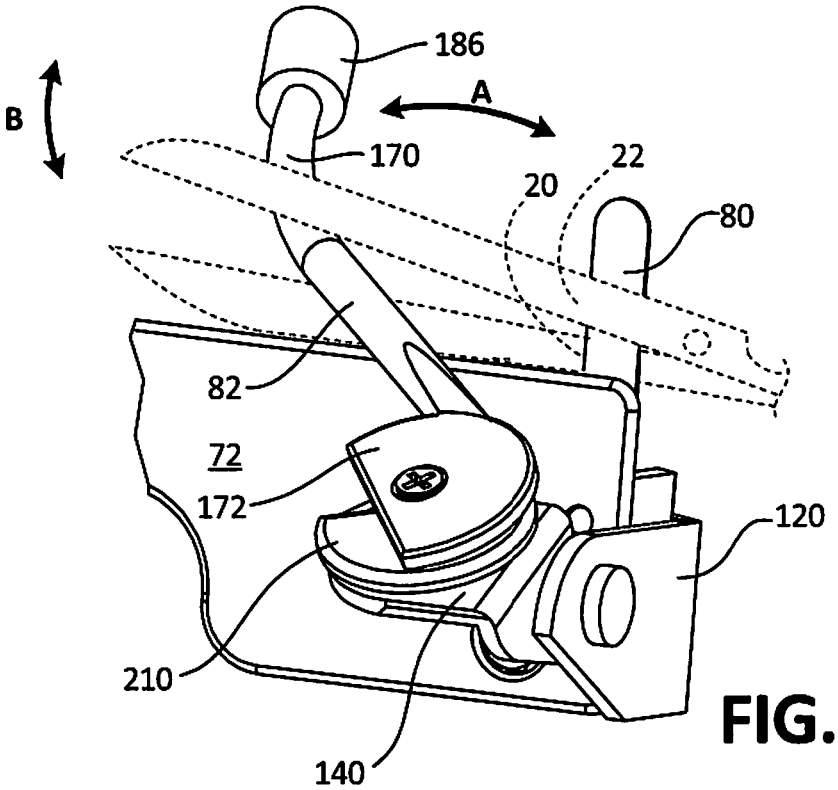
FIG. 20B is a partial perspective view of the scissors sharpener of FIG. 20A with the scissors blades further progressed through the sharpening process.

When the user closes the scissors blades against this curved sharpening steel arm 170, the applied force will cause the curved sharpening steel arm 170 to pivot in a backwards direction A away from stationary sharpening steel 80 and along the blades 20 and 22 of the scissors (see FIG. 20B). At the same time, the pivotable connection of pivot base plate 140 to anchor bracket 120 allows the curved sharpening steel arm 170 to move in an upwards direction B. This combination of backward and upwards pivoting by curved sharpening steel arm 170 provides improved sharpening of scissors blades 20 and 22 by the curved sharpening steel 170 and stationary sharpening steel 80 of scissors blades 20 and 22.

Turning to FIG. 11, the curved sharpening steel arm 170 of pivotable sharpening steel 82 has the three segments: straight segment 180, outwardly bowed segment 182, and bowed-back segment 184. The straight segment 180 commences the travel of the sharpening steel arm 170 along the scissors blades 20 and 22 as the blades are closed against it by the user. For a six-inch scissors blades, this straight segment 180 should be about 1-3½ inches long, preferably about 2 inches long. The back quarter of the scissors blades closest to the scissors pivot point will travel along this straight segment.

The sharpening steel arm 170 will travel along the length of the scissors blades until end cap 186 reaches the scissors blades to terminate the travel of the arm 170. When the outwardly bowed segment 182 of the sharpening steel arm 170 reaches the scissors blades, the round profile of the sharpening steel starts to realign the outwardly displaced deformations 62 in scissors blades 20 and 22 (see FIG. 4) to sharpen the blades, and the bowed-back segment 184 completes the task. Bowed-out segment 182 and bowed-back segment 184 provide the necessary gradual sweep of their exterior surfaces needed to accommodate the remaining three-quarters of the scissors blade length until the tip of the scissors blades contact the end cap 186 in order to sharpen the blades. If bowed-back segment 184 was straight instead of being bowed-back toward longitudinal axis B-B, the scissors blades would be choked off during the sharpening operation, which would destroy the blade edge.

The bowed-out segment 182 of the curved sharpening steel 170 should be about ½-1 inches in length, preferably % inch. The bowed-back segment 184 should be about ¼-¾% inches in length preferable ½ inch.

At the same time, the flat outside surfaces 110 of vertical stationary sharpening steel 80 act to ensure that the inside edges of the scissors blades are properly aligned to avoid any further damage to the scissors blades, and to realign the inwardly displaced deformations 60 along the scissors blades. The outwardly bowed profile of this segment 182 of the pivotable sharpening steel arm 170 enhances this sharpening action, and causes the sharpening arm to move further along the scissors blades 20 and 22. The more sharply sloped angle of the bowed-back segment 184 of the sharpening steel arm 170 reduces choking of the scissors blades around the pivotable sharpening steel arm 170. The upwardly sloped angle $\alpha$ of the pivotable sharpening steel arm 170 in the vertical plane also reduces this choking phenomenon.

As the sharpening steel arm 170 pivots in backwards A and upwards B directions to travel along the blades of the scissors to sharpen them, return spring 220 is stretched with its first ear segment 226 anchored in place to panel 144 of pivot base plate 140 by boss 176, while its second ear segment 228 travels along the rotational path of pivot arm plate 172 which is attached to the pivotable sharpening steel arm 170. When the user removes the scissors blades 20 and 22 from the pivotable sharpening steel 82 and stationary sharpening steel 80, the memory incorporated into return spring 220 draws back second ear segment 228 to rotate pivot arm plate 172 via boss 176 back around the pivot axis defined by pivot sleeve 190 and to thereby draw the curved sharpening steel arm 170 of pivotable sharpening steel 82 back to its standby position adjacent to stationary sharpening steel 80 shown in FIG. 20A. The scissors sharpener is now ready to receive a scissor blade to further sharpen the same pair of scissors or to sharpen another pair of scissors.

The structure of the scissors sharpener of the present invention therefore provides improved sharpening of both the interior and exterior surfaces of the scissors blades as the vertical sharpening steel 80 works in combination with the curved sharpening steel arm 170 which can pivot in three dimensional space both in a backwards and upwards direction. At the same time, the return spring 220 enables the pivotable sharpening steel arm 170 to be automatically returned to its standby position upon disengagement of the scissors blades from the scissors sharpener without having to rely upon gravitational force, as many prior art bench top scissors sharpener devices do the scissors sharpener 70 can actually be used upside down. This allows the scissors sharpener of the present invention to constitute a portable, hand-held model that can conveniently be used by a person in a work place without having to maintain the necessary spatial orientation of the curved sharpening steel to enable it to return to its standby position by gravitational force. There is also no need for the user to take the time to travel within the work place to an available bench top scissors sharpener.

Figure 21:
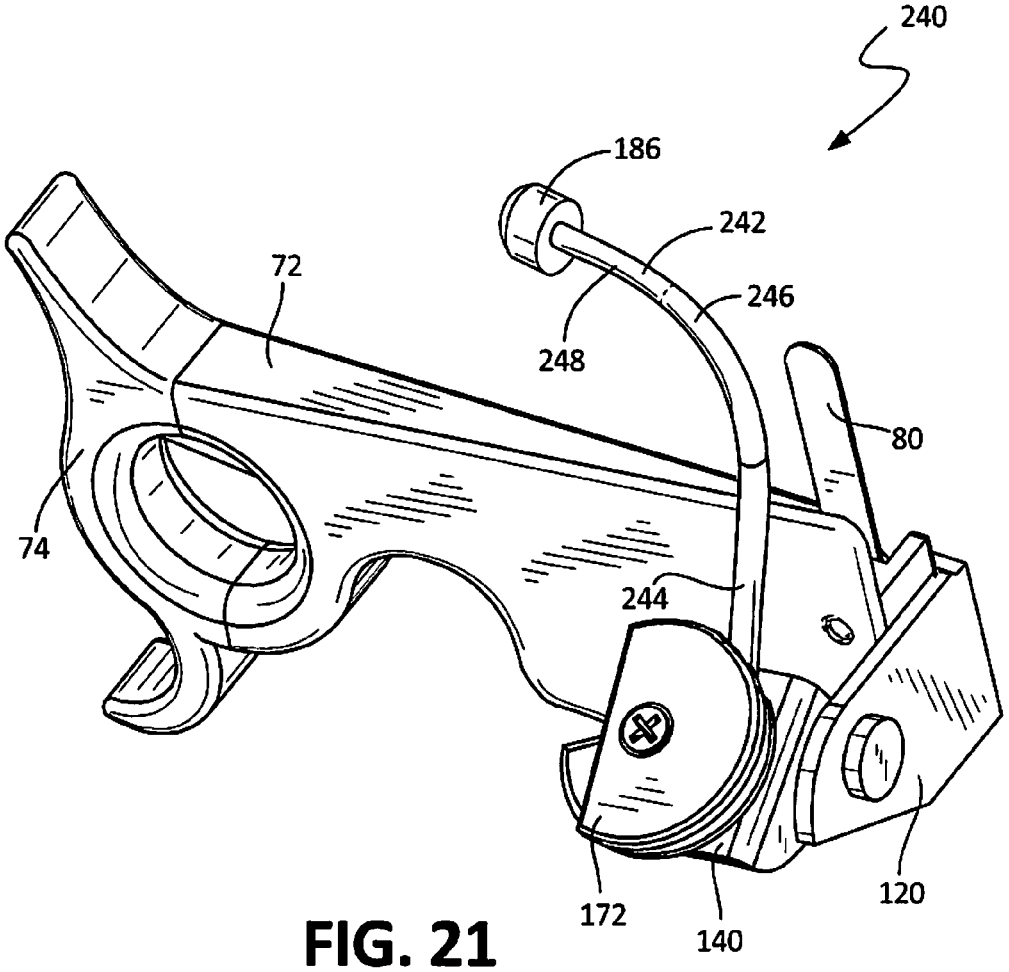
FIG. 21 is a perspective view of a second embodiment of the scissors sharpener device of the present invention.
Figure 22:
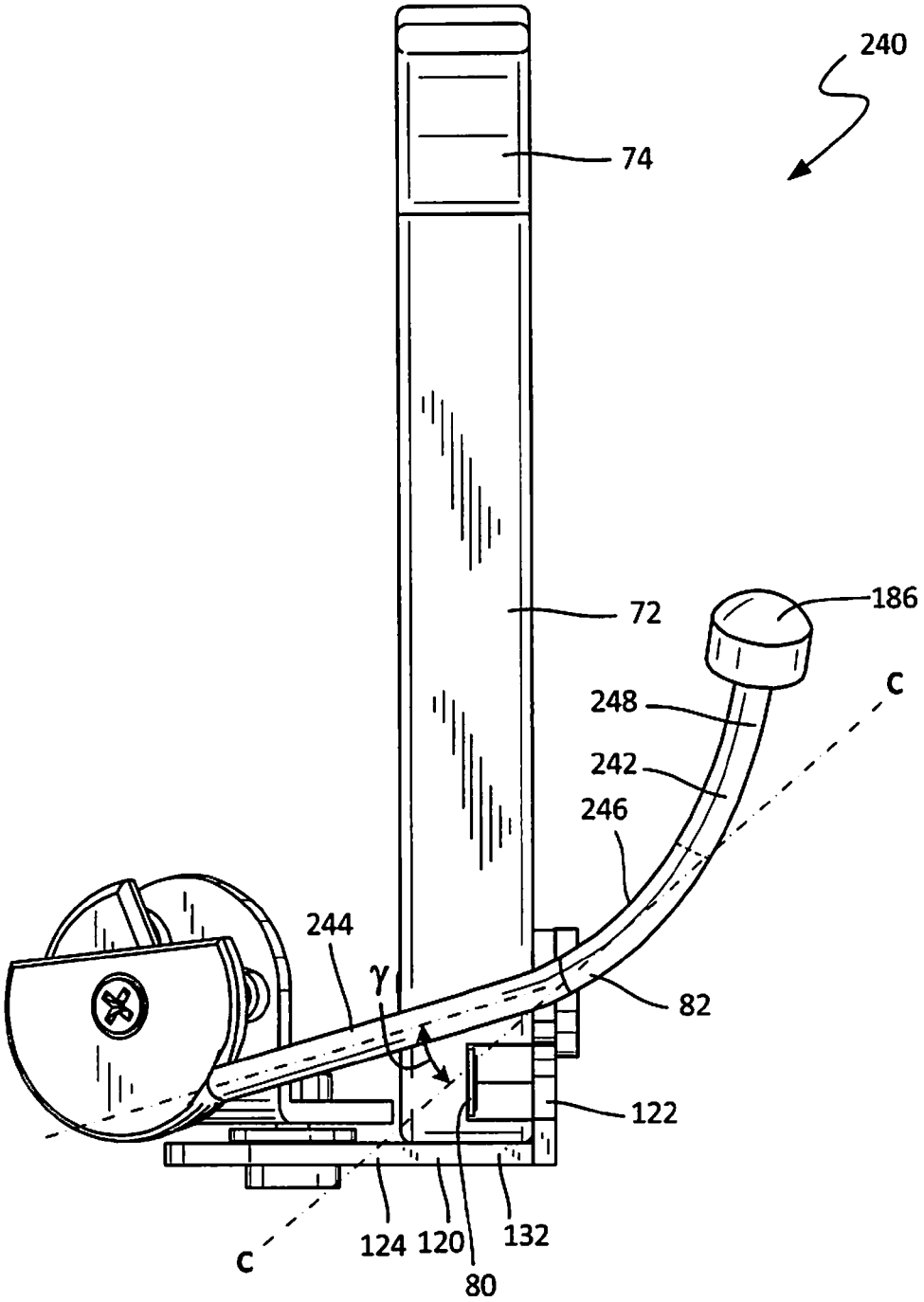
FIG. 22 is a top plan view of the scissors sharpener of FIG. 21.

Another embodiment of the scissors sharpener 240 of the present invention is shown in FIGS. 21-22. Its structure is similar to the scissors sharpener 70 embodiment described above, and like numbers are used for the similar elements of the scissors sharpener 240. The primary difference is the configuration of pivotable curved sharpening steel arm 242. Longitudinal axis C-C is depicted in FIG. 22. When viewed in the horizontal plane shown in FIG. 22, straight segment 244 is similar to straight segment 180 of the pivotable sharpening arm 170 of scissors sharpener 70, shown in FIG. 11, and approaches longitudinal axis C-C at angle 7. However, segment 246 shown in FIG. 22 is bowed inwardly towards the front edge 132 of the scissors sharpener main body 72 and away from longitudinal axis C-C, instead of being outwardly bowed like segment 182 shown in FIG. 11. Segment 248 is also bowed away from longitudinal axis C-C, instead of being bowed back towards the front as in segment 184 shown in FIG. 11.

For a six-inch scissors blades, the length of straight segment 244 should be about 1-2⅜ inches, preferably about 1½-1¾ inches. Similarly, the length of bowed-in segment 246 should be about ½-1¼ inches, preferably about ½ inch. Finally, bowed-away segment 248 should be about ¼-1 inch, preferably about ½ inch.

This alternative curved profile for the pivotable curved sharpening steel arm 242 has been found to provide a stronger edge along the scissors blades 20 and 22.

Thus, the first scissors sharpener embodiment 70 can be used to produce a sharp edge to the scissors blades. The same scissors can then be treated by the second scissors sharpener embodiment 240 to strengthen these sharpened blade edges so they last longer in use before becoming dull again.

Figure 23:
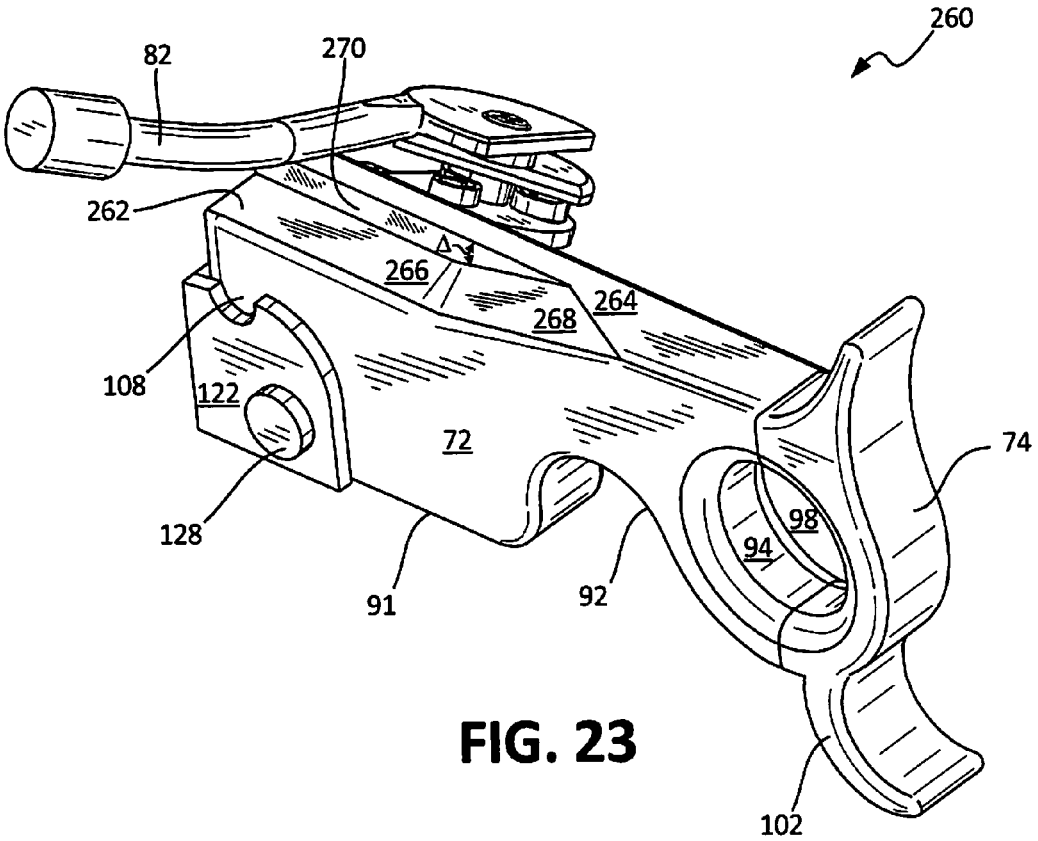
FIG. 23 is a perspective view of a third embodiment of the scissors sharpener of the present invention with a longitudinal niche in lieu of the vertical stationery sharpening steel.

Still another embodiment 260 of the present invention is shown in FIGS. 23-25B. Its structure is similar to the scissors sharpener 70 embodiment described above, and like numbers are used for the similar elements of the scissors sharpener 260. However, there is no stationary vertical sharpening steel 80 in the scissors sharpener 260 or vertical niche 100 for receiving such a vertical sharpening steel see FIG. 7). Instead, as shown in FIG. 23, there is a horizontal niche 262 formed within the top surface 264 of the main body 72 of the scissors sharpener 260. This horizontal niche 262 has a first bottom surface 266, second bottom surface 268, and side wall 270. The first bottom surface is flat. Second bottom surface is also flat, but it is upwardly inclined with respect to the first bottom surface at an angle Δ with respect to the top surface 264. Angle Δ is about 10-20 degrees, preferably about 15 degrees.

Figure 24:
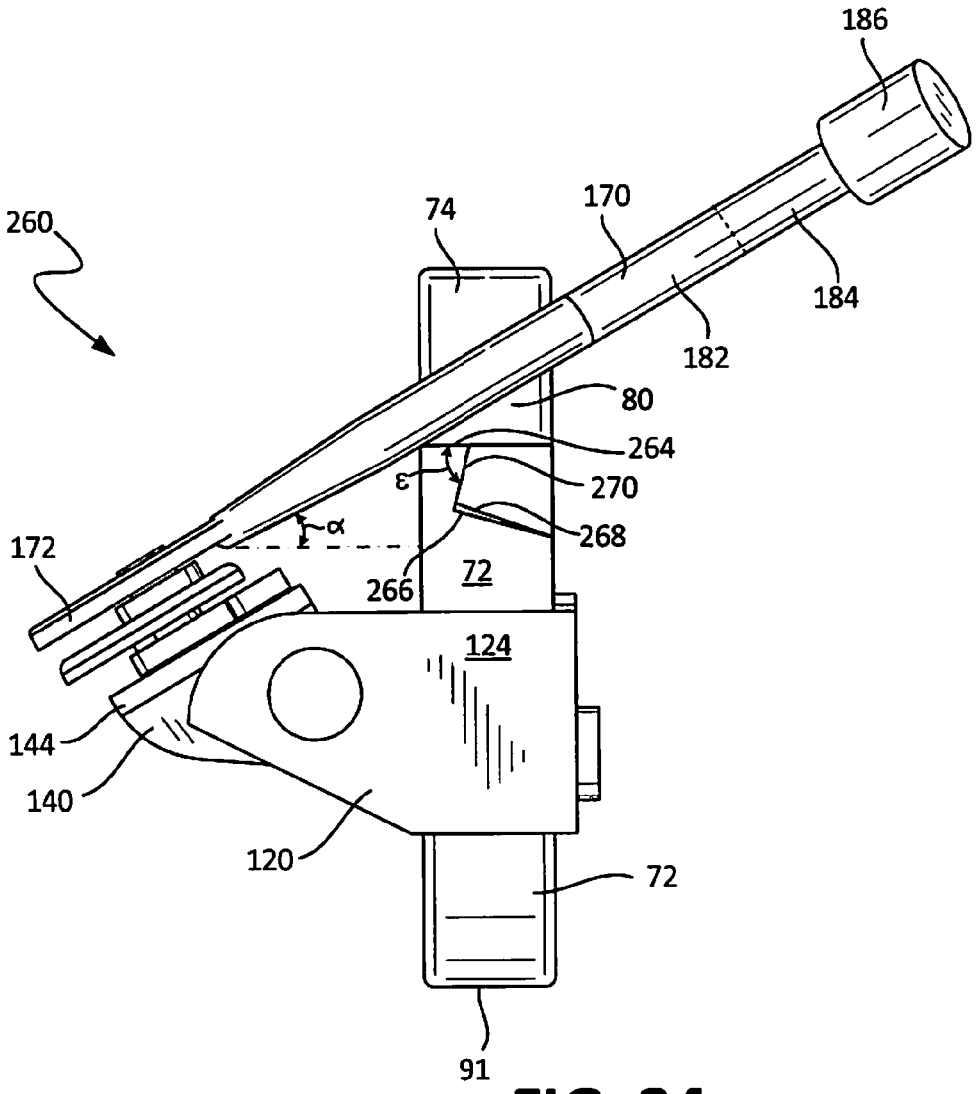
FIG. 24 is a front elevational view of the scissors sharpener of FIG. 23.

As shown in FIG. 24, side wall 270 is inclined with respect to top surface 264 of main body 72 at angle ϵ. Angle ϵ is about 65-85 degrees, preferable 75 degrees. Meanwhile, first bottom surface 266 is also upwardly inclined with respect to top surface 264. First bottom surface 266 meets side wall 270 at approximately a 90-degree angle.

Figure 25A:
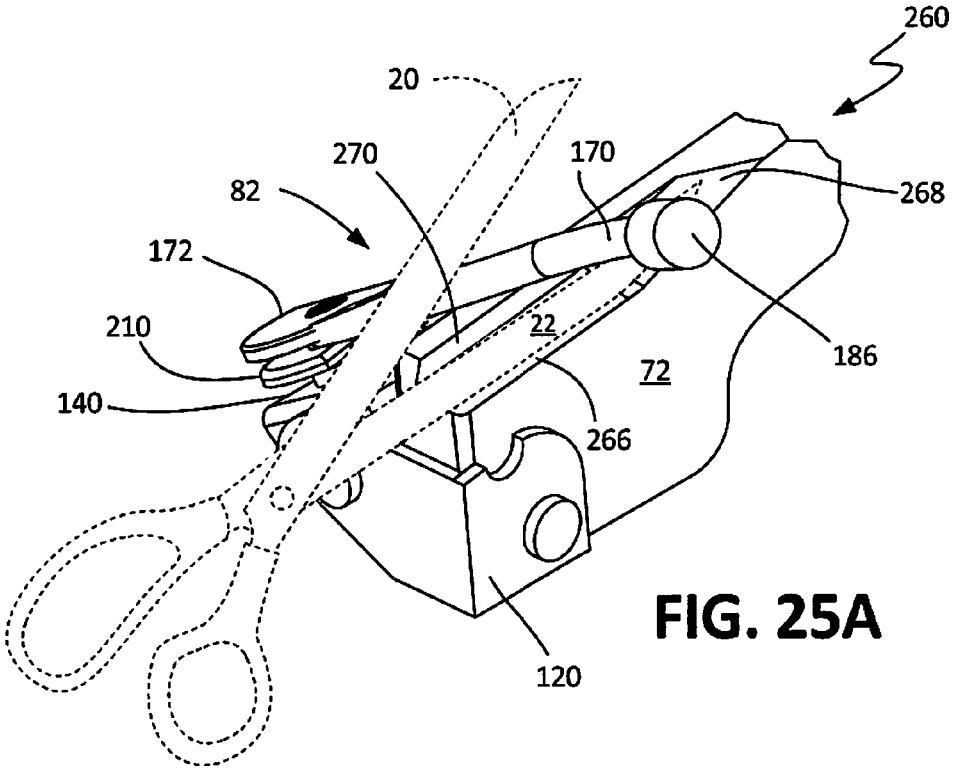
FIG. 25A is a partial perspective view of the scissors sharpener of FIG. 23 with the scissors blades starting the sharpening process.

Turning to FIG. 25A, the pivotable sharpening steel 82 is shown in its standby position with its curved sharpening steel area 170 forward towards the front of the scissors sharpener 260. A pair of scissors 10 is inserted with the blade 22 set into horizontal niche 262. The bottom of blade 22 rests on top of first bottom surface 266 and upwardly inclined second bottom surface 268, while exterior face 52 of blade 22 rests against inclined side wall 270. The portion of blade 22 closer to the tip is positioned below curved sharpening steel arm 170, while the portion of blade 20 is positioned above the curved sharpening steel arm 170.

Figure 25B:
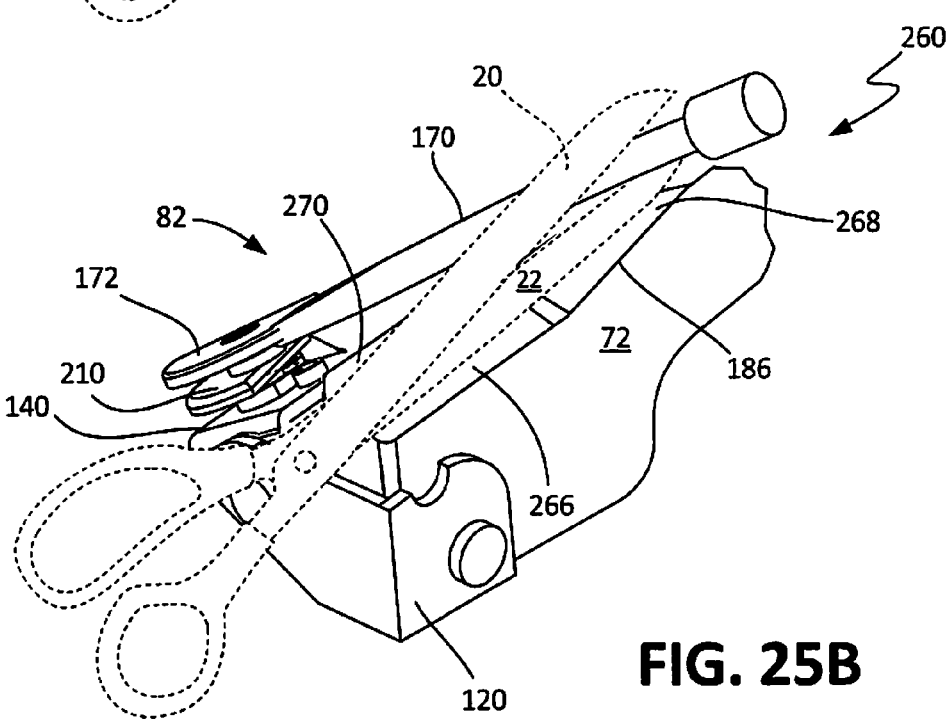
FIG. 25B is a partial perspective view of the scissors sharpener of FIG. 25A with the scissors blades further progressed through the sharpening process.

When the user closes the scissors blades against this curved sharpening steel arm 170, the applied force will cause the curved sharpening steel arm 170 to pivot in a backwards direction A away from stationary sharpening steel 80 and along the blades 20 and 22 of the scissors (see FIG. 25B). At the same time, the pivotable connection of pivot base plate 140 to anchor bracket 120 allows the curved sharpening steel arm 170 to move in an upwards direction B. This combination of backward and upwards pivoting by curved sharpening steel arm 170 provides improved sharpening of scissors blades 20 and 22 by the curved sharpening steel 170.

Turning to FIG. 11, the curved sharpening steel arm 170 of pivotable sharpening steel 82 has the three segments: straight segment 180, outwardly bowed segment 182, and bowed-back segment 184. The straight segment 180 commences the travel of the sharpening steel arm 170 along the scissors blades 20 and 22 as the blades are closed against it by the user. For a six-inch scissors blades, this straight segment 180 should be about 1-3½ inches long, preferably about 2 inches long. The back quarter of the scissors blades closest to the scissors pivot point will travel along this straight segment.

The sharpening steel arm 170 will travel along the length of the scissors blades until end cap 186 reaches the scissors blades to terminate the travel of the arm 170. When the outwardly bowed segment 182 of the sharpening steel arm 170 reaches the scissors blades, the round profile of the sharpening steel starts to realign the outwardly displaced deformations 62 in scissors blades 20 and 22 (see FIG. 4) to sharpen the blades, and the bowed-back segment 184 completes the task. Bowed-out segment 182 and bowed-back segment 184 provide the necessary gradual sweep of their exterior surfaces needed to accommodate the remaining three-quarters of the scissors blade length until the tip of the scissors blades contact the end cap 186 in order to sharpen the blades. If bowed-back segment 184 was straight instead of being bowed-back toward longitudinal axis B-B, the scissors blades would be choked off during the sharpening operation, which would destroy the blade edge.

The bowed-out segment 182 of the curved sharpening steel 170 should be about ½-1 inches in length, preferably ¾ inch. The bowed-back segment 184 should be about ¼-¾ inches in length preferable ¼ inch.

At the same time, the vertically-inclined side wall 270 and inclined first bottom surface 266 and second bottom surface 268 of horizontal niche 262 in main body 72 of scissors sharpener 260 provides stable orientation of scissors 10 to avoid any further damage to the scissors blades 20 and 22 while the blades engage the curved sharpening steel 170 to realign the inwardly displaced deformations 60 along the scissors blades. As the scissors cutting edges get sharpened and polished, they in turn will act themselves to sharpen the inside edges of the blades. In this manner the stationary sharpening steel 80 of the first and second embodiments is unnecessary. This lack of the stationary sharpening steel 80 enables faster sharpening of a pair of scissors by the user, because the user does not need to engage the scissors blades with the stationary sharpening steel before engaging them with the curved sharpening steel 270. The outwardly bowed profile of this segment 182 of the pivotable sharpening steel arm 170 enhances this sharpening action, and causes the sharpening arm to move further along the scissors blades 20 and 22. The more sharply sloped angle of the bowed-back segment 184 of the sharpening steel arm 170 reduces choking of the scissors blades around the pivotable sharpening steel arm 170. The upwardly sloped angle $\alpha$ of the pivotable sharpening steel arm 170 in the vertical plane also reduces this choking phenomenon.

As the sharpening steel arm 170 pivots in backwards A and upwards B directions to travel along the blades of the scissors to sharpen them, return spring 220 is stretched with its first ear segment 226 anchored in place to panel 144 of pivot base plate 140 by boss 176, while its second ear segment 228 travels along the rotational path of pivot arm plate 172 which is attached to the pivotable sharpening steel arm 170. When the user removes the scissors blades 20 and 22 from the pivotable sharpening steel 82 and stationary sharpening steel 80, the memory incorporated into return spring 220 draws back second ear segment 228 to rotate pivot arm plate 172 via boss 176 back around the pivot axis defined by pivot sleeve 190 and to thereby draw the curved sharpening steel arm 170 of pivotable sharpening steel 82 back to its standby position adjacent to stationary sharpening steel 80 shown in FIG. 20A. The scissors sharpener is now ready to receive a scissor blade to further sharpen the same pair of scissors or to sharpen another pair of scissors.

The structure of the scissors sharpener of this third embodiment therefore provides improved sharpening of both the interior and exterior surfaces of the scissors blades as the horizontal niche 260 works in combination with the curved sharpening steel arm 170 which can pivot in three dimensional space both in a backwards and upwards direction. At the same time, the return spring 220 enables the pivotable sharpening steel arm 170 to be automatically returned to its standby position upon disengagement of the scissors blades from the scissors sharpener without having to rely upon gravitational force, as many prior art bench top scissors sharpener devices do the scissors sharpener 70 can actually be used upside down. This allows the scissors sharpener of the present invention to constitute a portable, hand-held model that can conveniently be used by a person in a work place without having to maintain the necessary spatial orientation of the curved sharpening steel to enable it to return to its standby position by gravitational force. There is also no need for the user to take the time to travel within the work place to an available bench top scissors sharpener.

The curved sharpening steel 242 of the second embodiment can be substituted for the curved sharpening steel 170 in this third embodiment in order to strengthen the cutting edges of the scissors blades 20 and 22 after they have been sharpened.

The above specification and associated drawings provide a complete description of the structure and operation of the scissors sharpener of the present invention. Many alternative embodiments of the invention can be made without departing from the spirit and scope of the invention. Therefore, the invention resides in the claims herein appended.

We claim:

1. A scissors sharpener for sharpening the pivotable blades of a pair of scissors used to shear a cut substrate, said scissors having a first blade having a first inside surface and a first cutting edge, and a second blade having a second inside surface and a second cutting edge, said scissors sharpener comprising:

(a) a main body having a top surface;

(b) a stationary sharpening steel having opposed surfaces that is securely attached to the main body and extends vertically above the top surface of the main body;

(c) a bracket secured to the main body having a pivotable mounting assembly;

(d) a pivotable sharpening steel having a first end with a mounting plate and a second end, the mounting plate of the pivotable sharpening steel operably connected to the mounting assembly of the bracket so that the pivotable sharpening steel rotates with respect to the main body from a standby position;

(e) a U-shaped return spring having a first end and a second end, said return spring being positioned between the bracket and the mounting plate of the pivotable sharpening steel with its first end attached to the bracket and its second end attached to the mounting plate of the pivotable sharpening steel;

(f) wherein when the scissors blades engage the scissors sharpener with the first inside blade surface and second inside blade surface abutting the opposed surfaces of the stationery sharpening steel, and the first blade positioned above the pivotable sharpening steel is closed with respect to the second blade positioned below the pivotable sharpening steel, the pivotable sharpening steel pivots with respect to the main body to travel from its standby position along the first blade cutting edge and the second blade cutting edge to sharpen the cutting edges of the scissors; and (g) wherein when the scissors blades are disengaged from the stationery sharpening steel and the pivotable sharpening steel, the return spring biases the pivotable sharpening steel back to its standby position.

2. The scissors sharpener of claim 1, wherein the pivotable sharpening steel is made from hardened steel, stainless steel, stainless steel-carbon alloy, diamond-coated steel, or ceramic material.

3. The scissors sharpener of claim 1, wherein the stationary sharpening steel is made from hardened steel, stainless steel, stainless steel-carbon alloy, diamond-coated steel, or ceramic material.

4. The scissors sharpener of claim 1, wherein the pivotable sharpening steel extends in a vertical plane from the pivotable mounting assembly at an upwardly inclined angle with respect to the top surface of the main body in order to reduce choking of the scissors blades as the pivotable sharpening steel travels along their cutting edges.

5. The scissors sharpener of claim 1, wherein the pivotable sharpening steel comprises a curved sharpening steel arm extending from the mounting plate.

6. The scissors sharpener of claim 5, wherein the curved sharpening steel arm comprises in a horizontal plane a straight segment at an angle with respect to a longitudinal axis, a first curved segment bowed away from the longitudinal axis, and a second curved segment bowed towards the longitudinal axis.

7. The scissors sharpener of claim 5, wherein the curved sharpening steel arm comprises in a horizontal plane a straight segment at an angle with respect to a longitudinal axis, a first curved segment bowed towards the longitudinal axis, and a second curved segment bowed away from the longitudinal axis.

8. The scissors sharpener of claim 1 further comprising a continued surface formed within a surface of the main body for enabling a user's hand to grasp the scissors sharpener more securely during a scissors sharpening operation.

9. The scissors sharpener of claim 1 further comprising a handle attached to the main body for enabling a user's hand to grasp the scissors sharpener more securely during a scissors sharpening operation.

10. The scissors sharpener of claim 1, wherein the bracket is pivotably connected to the main body so that the pivotable sharpening steel can additionally rotate in an upwards and downwards direction as it travels along the cutting edges of the first blade and the second blade during the sharpening operation.

* * * * *